US012134893B2

(12) United States Patent
Oleske et al.

(10) Patent No.: US 12,134,893 B2
(45) Date of Patent: Nov. 5, 2024

(54) ACOUSTICAL CEILING SYSTEM

(71) Applicant: ARMSTRONG WORLD INDUSTRIES, INC., Lancaster, PA (US)

(72) Inventors: Peter J Oleske, Lancaster, PA (US); Stephen G Mearig, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 569 days.

(21) Appl. No.: 17/089,247

(22) Filed: Nov. 4, 2020

(65) Prior Publication Data

US 2021/0131101 A1 May 6, 2021

Related U.S. Application Data

(60) Provisional application No. 62/931,081, filed on Nov. 5, 2019.

(51) Int. Cl.

| | |
|---|---|
| ***E04B 9/00*** | (2006.01) |
| ***E04B 9/04*** | (2006.01) |
| ***E04B 9/18*** | (2006.01) |
| ***E04B 9/24*** | (2006.01) |
| ***E04B 9/34*** | (2006.01) |

(52) U.S. Cl.

CPC ..... *E04B 9/001* (2013.01); *E04B 9/0435* (2013.01); *E04B 9/18* (2013.01); *E04B 9/241* (2013.01); *E04B 9/34* (2013.01); *E04B 2103/02* (2013.01); *E04B 2103/04* (2013.01)

(58) Field of Classification Search

None

See application file for complete search history.

(56) References Cited

U.S. PATENT DOCUMENTS

| | | | | |
|---|---|---|---|---|
| 1,997,606 | A * | 4/1935 | Strom | E04B 9/26 52/145 |
| 1,998,423 | A * | 4/1935 | Stubbs | E04B 9/26 52/145 |
| 3,183,996 | A | 5/1965 | Capaul | |
| 4,201,247 | A | 5/1980 | Shannon | |
| 4,642,951 | A | 2/1987 | Mortimer | |
| 4,901,485 | A | 2/1990 | Menchetti et al. | |
| 5,202,174 | A | 4/1993 | Capaul | |
| 6,443,256 | B1 | 9/2002 | Baig | |
| 6,789,645 | B1 | 9/2004 | Deblander | |
| 7,658,046 | B2 | 2/2010 | Lynch et al. | |

(Continued)

FOREIGN PATENT DOCUMENTS

| | | | | |
|---|---|---|---|---|
| CN | 206220333 U | 6/2017 | | |
| DE | 19702099 A1 * | 7/1998 | | E04B 9/064 |

(Continued)

*Primary Examiner* — Joshua K Ihezie

(74) *Attorney, Agent, or Firm* — Patrick Sheldrake

(57) ABSTRACT

Described herein is a ceiling system comprising: a support grid; a first panel mounted to the support grid, the first panel comprising a first body formed of a fibrous material; a second panel mounted to the support grid, the second panel comprising a second body formed of a sound attenuation material; whereby the first and second panels are supported by the support grid such that a vertical gap exists between the first panel and the second panel such that the first and second panels are not in direct contact.

19 Claims, 14 Drawing Sheets

(56) References Cited

U.S. PATENT DOCUMENTS

| | | | | |
|---|---|---|---|---|
| 7,703,254 | B2 | 4/2010 | Alderman | |
| 7,798,287 | B1 * | 9/2010 | Surace | E04B 9/0435 181/290 |
| 8,734,613 | B1 | 5/2014 | Frank et al. | |
| 9,238,912 | B1 * | 1/2016 | Pham | E04B 1/8409 |
| 11,408,171 | B1 * | 8/2022 | Hallowell | E04B 9/068 |
| 2014/0362563 | A1 * | 12/2014 | Zimmerman | F21S 8/026 362/147 |
| 2015/0345139 | A1 | 12/2015 | Underkofler | |
| 2016/0145863 | A1 * | 5/2016 | Bergman | E04B 9/06 52/698 |
| 2017/0146251 | A1 * | 5/2017 | Radzinsky | F24F 5/0092 |
| 2018/0355606 | A1 * | 12/2018 | Alderman | E04B 1/78 |
| 2019/0072249 | A1 * | 3/2019 | Bobbo | F21S 8/043 |
| 2020/0347595 | A1 * | 11/2020 | Baxter | E04B 9/10 |
| 2021/0190278 | A1 * | 6/2021 | Bartella | F21S 8/026 |
| 2022/0010554 | A1 * | 1/2022 | Yeo | E04B 9/006 |

FOREIGN PATENT DOCUMENTS

| | | | | |
|---|---|---|---|---|
| DE | 10060103 | A1 * | 6/2002 | E04B 9/001 |
| EP | 2631380 | B1 | 3/2015 | |
| WO | WO 9745605 | A1 | 12/1997 | |

* cited by examiner

ACOUSTICAL CEILING SYSTEM

BACKGROUND

Various types of ceiling systems have been used in commercial and residential building construction to provide the desired acoustical performance. Noise blocking between rooms is required for a variety of purposes, including speech privacy as well as not bothering the occupants of adjacent rooms. Sound dampening within a single room is also required for a variety of purposes, including decreasing volume levels within a single space.

Previous attempts have been made to improve noise blocking between adjacent rooms. However, such previous attempts have either been directed to single layered structures or laminate-structures. Such previous attempts fail to provide dynamic flexibility in adjusting both noise blocking and sound dampening characteristics of the ceiling system. Thus, there is a need for a new ceiling system that can provide the desired acoustical properties as well as flexibility in how those properties can be modified.

BRIEF SUMMARY

The present invention is directed to a suspended ceiling system comprising: a ceiling grid comprising: a first support; a second support; the first support is vertically offset from the second support by a first offset distance; a first panel supported by the first support, the first panel comprising a first exposed major surface opposite a second exposed major surface, the first panel exhibiting an NRC value ranging from about 0.3 to about 0.99; a second panel supported by the second support, the second panel having a first exposed major surface opposite a second exposed major surface, whereby no line of sight extends exists between the first and second exposed major surfaces of the second panel; wherein the second exposed major surface of the first panel faces the first exposed major surface of the second panel, and the second exposed major surface of the first panel is vertically offset from the first exposed major surface of the second panel by a second offset distance; wherein the first offset distance and the second offset distance are each positive non-zero values.

Other embodiments of the present invention include an acoustical ceiling system comprising: a support grid having a plurality of grid openings; a first panel mounted to the support grid within a first one of the plurality of grid openings, the first panel comprising a first exposed major surface opposite a second exposed major surface, the first panel comprising a first body formed of a fibrous material; a second panel mounted to the support grid within the first one of the plurality of grid openings, the second panel comprising a first exposed major surface opposite a second exposed major surface, the second panel comprising a second body formed of a sound attenuation material; whereby the first and second panels are supported by the support grid such that the second exposed major surface of the first panel faces the first exposed major surface of the second panel, and wherein a vertical gap exists between the second exposed major surface of the first panel and the first exposed major surface of the second panel such that the first and second panels are not in direct contact.

Other embodiments of the present invention include a method of installing an acoustical ceiling system comprising: a) providing a ceiling grid comprising at least one grid opening, a first support, and a second support, the first and second supports vertically offset from each other by a first offset distance; b) mounting a first panel and a second panel within the grid opening such that the first panel is supported by the first support and the second panel is supported by the second support within the grid opening; wherein a gap is formed between the first panel and the second panel within the grid opening such that the first and second panels are not in direct contact.

Other embodiments of the present invention include a method of fabricating an acoustical ceiling system comprising: a) assessing a room environment for a noise reducing performance and a sound attenuation performance; b) designing a support grid that comprises a support strut having a top surface, a first panel support having a first support surface, and a second panel having a second panel support surface, the first support surface vertically offset from the second support surface by a first offset distance, whereby a first relative distance exists between the first support surface and the top surface of the support strut and a second relative distance exists between the second support surface and the top surface of the support strut; c) modifying the first offset distance based on the noise reducing performance and sound attenuation performance of step a) by adjusting at least one of the first relative distance and the second relative distance; d) fabricating the support grid to have the first offset distance modified in step c).

Other embodiments of the present invention include an acoustical ceiling system comprising: a ceiling grid having a plurality of grid openings, the ceiling grid comprising a plurality of longitudinal members each having a first support and a second support; a first panel comprising a first exposed major surface opposite a second exposed major surface, the first panel mounted beneath the first support of the longitudinal member and supported by mounting hardware that is coupled to the first support; a second panel comprising a first exposed major surface opposite a second exposed major surface, the second panel located above the first panel and supported by the second support; wherein the second exposed major surface of the first panel faces the first exposed major surface of the second panel, and wherein a vertical gap exists between the second exposed major surface of the first panel and the first exposed major surface of the second panel such that the first and second panels are not in direct contact.

Other embodiments of the present invention include an acoustical ceiling system comprising: a ceiling grid having a plurality of grid openings, the ceiling grid comprising a plurality of longitudinal members each having a first support having an upper surface opposite a lower surface and a second support having an upper surface opposite a lower surface; a first panel comprising a first exposed major surface opposite a second exposed major surface and a side surface extending between the first and second exposed major surfaces, the side surface comprises an edge geometry configured to receive at least a portion of the first support; a second panel comprising a first exposed major surface opposite a second exposed major surface, the second panel located above the first panel and supported by the second support; wherein edge geometry of the side surface of the first panel receives at least a portion of the first support such that the first panel is supported by the first support in a vertical direction and at least a portion of the lower surface of the first support is concealed by the first panel; and wherein the second exposed major surface of the first panel faces the first exposed major surface of the second panel, and wherein a vertical gap exists between the second exposed major surface of the first panel and the first exposed major surface of the second panel such that the first and second panels are not in direct contact.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
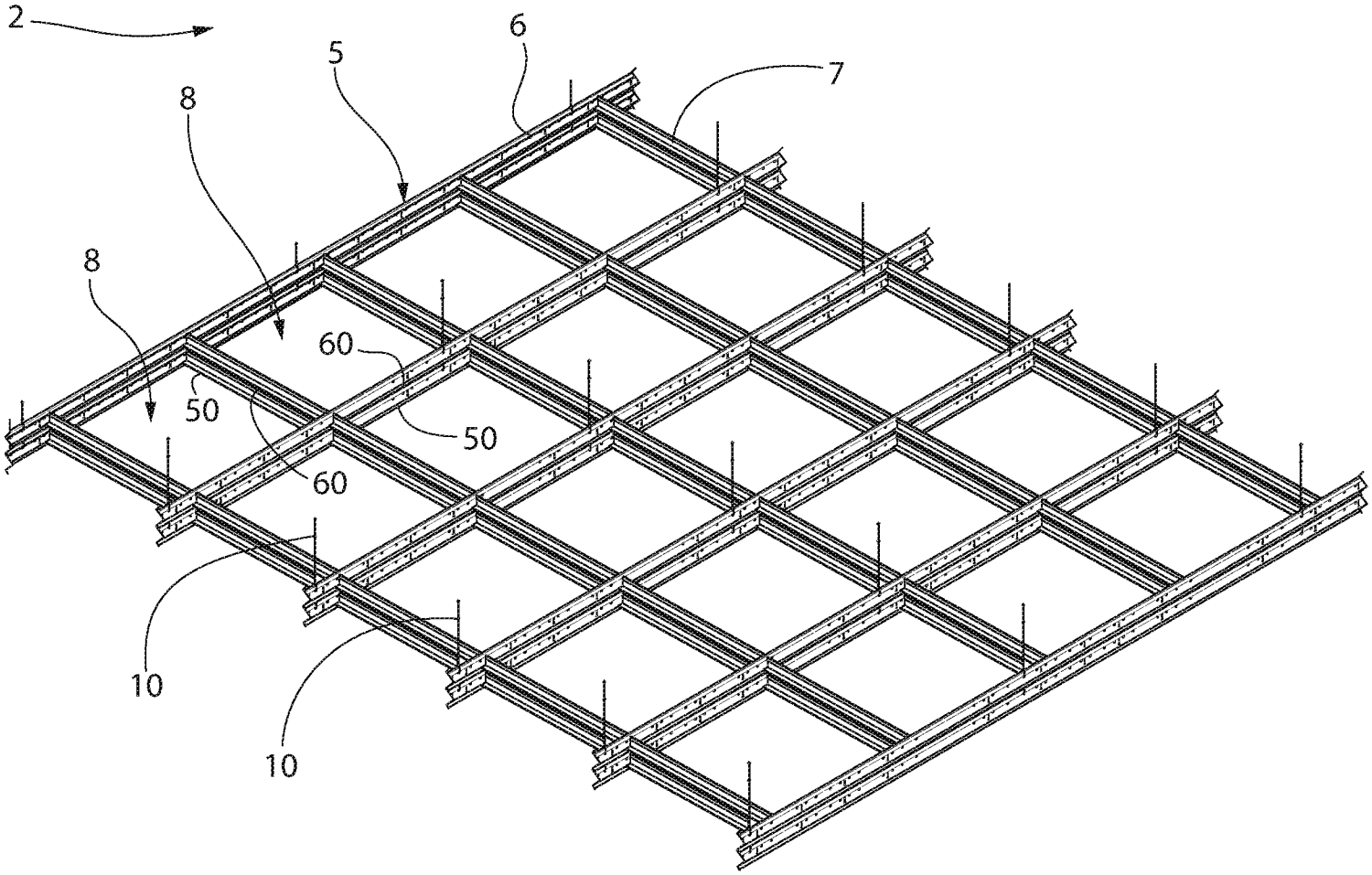
FIG. 1 is top perspective view of a ceiling grid according to the present invention.
Figure 2:
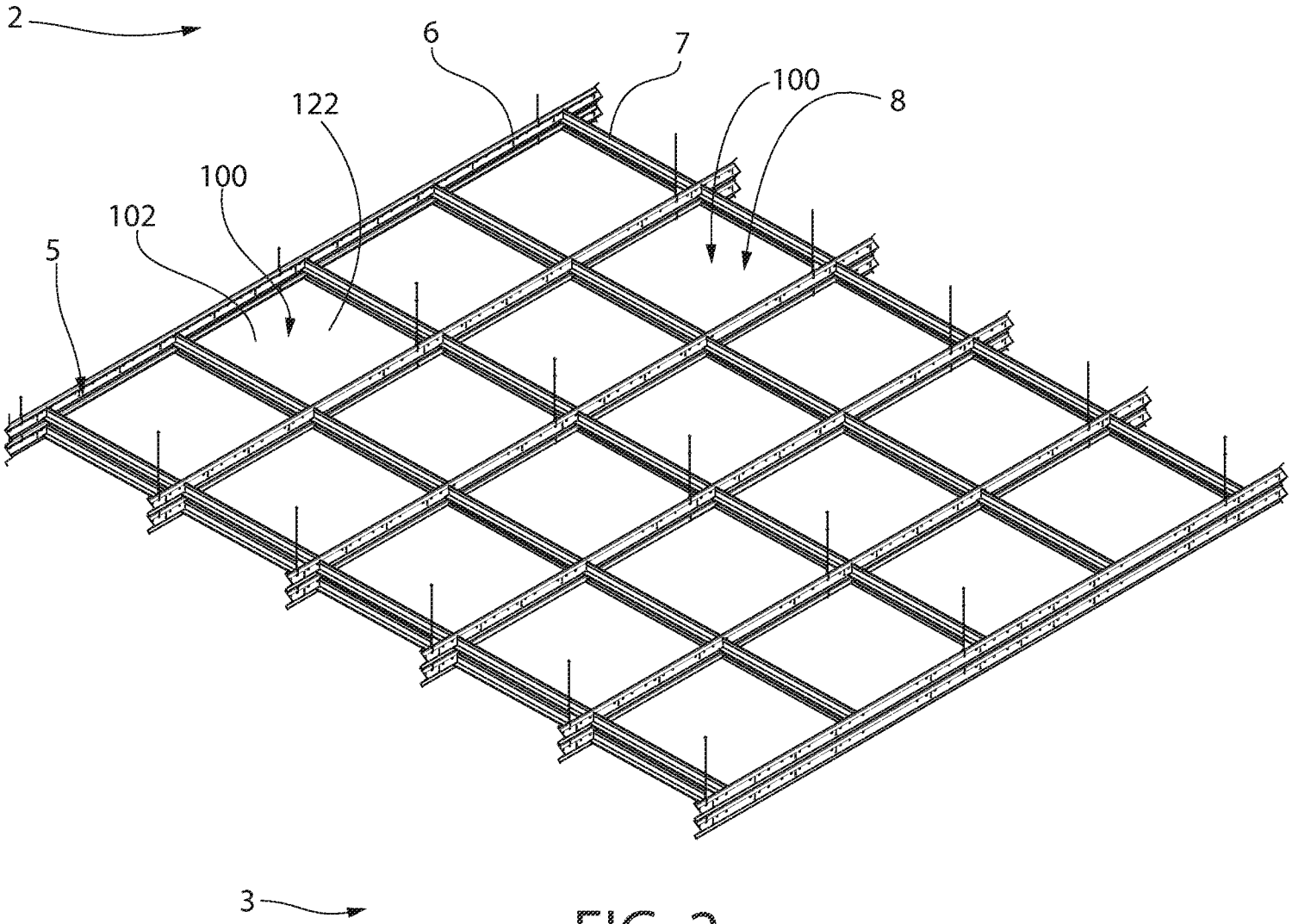
FIG. 2 is a top perspective view of a partially installed ceiling system comprising the ceiling grid of FIG. 1.
Figure 3:
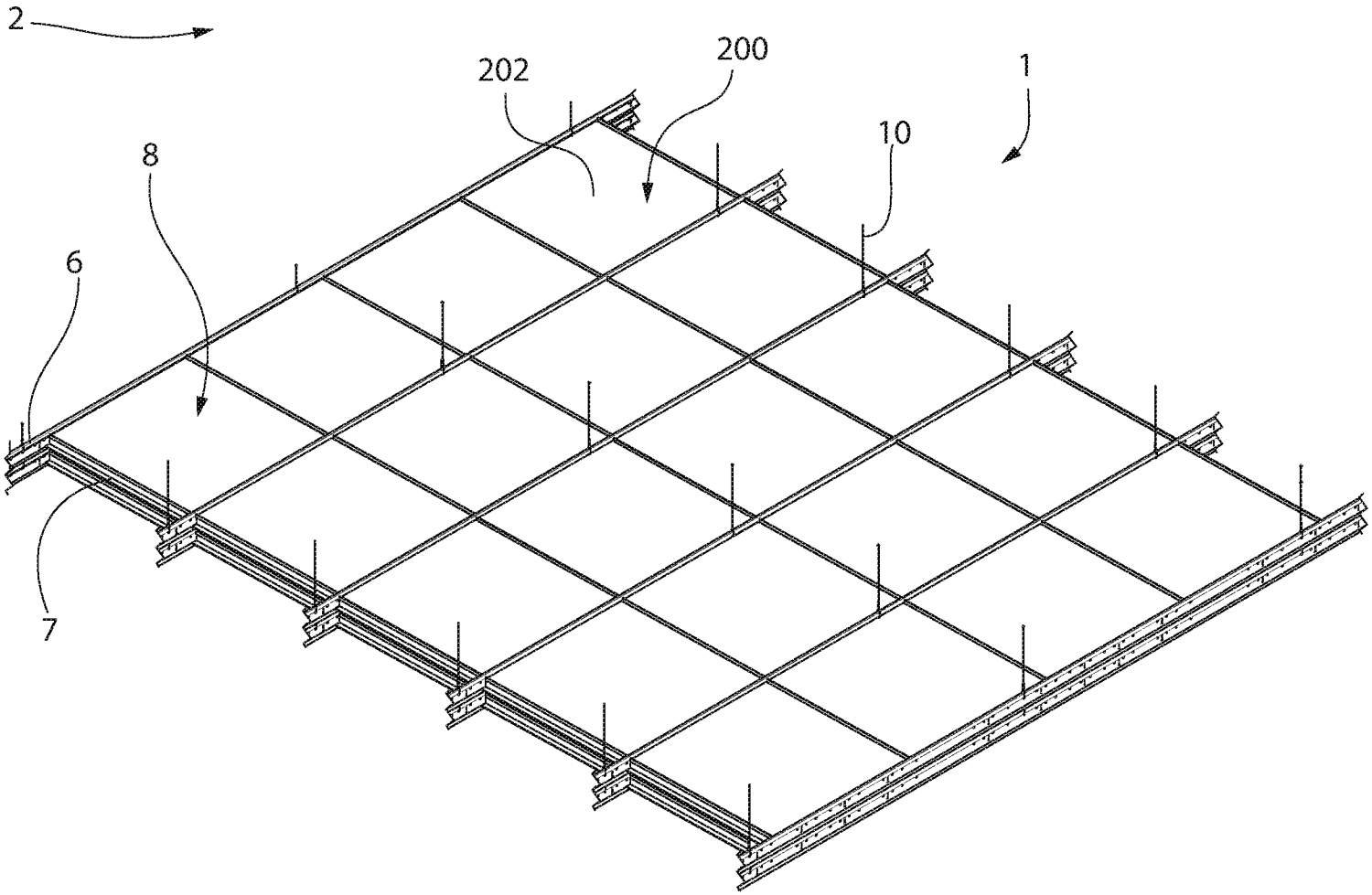
FIG. 3 is a top perspective view of a fully installed ceiling system comprising the ceiling grid of FIG. 1.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

As shown in FIGS. 1-3, 6, and 8, the present invention is directed to a ceiling system 1 comprising a support grid 5, a first panel 100, and a second panel 200. The ceiling system 1 may be positioned in a room environment comprising a plenary space 2 and an active room area 3.

The plenary space 2 may exist above the support grid 5. The plenary space 2 may be the space that exists above the first panel 100 and the second panel 200 as well as above the support grid 5 and below a roof or a subfloor 4 of an above adjacent floor in a building. The plenary space 2 provides room for mechanical lines to be run throughout a building—e.g. HVAC, plumbing, data lines, etc. The active room area 3 may exist below the first panel 100, the second panel 200, and the support grid 5. The active room area 3 provides room for the building occupants during normal intended use of the building (e.g., in an office building, the active space would be occupied by offices containing computers, lamps, etc.). The ceiling system 1 comprising the combination of the support grid 5, the first panel 100, and the second panel 200 may provide an acoustic, thermal, and aesthetic barrier between the active room area 3 and the plenary space 2, as well as a sound deadening layer for noise that exists within the active room area 3, as discussed herein.

Figure 6:
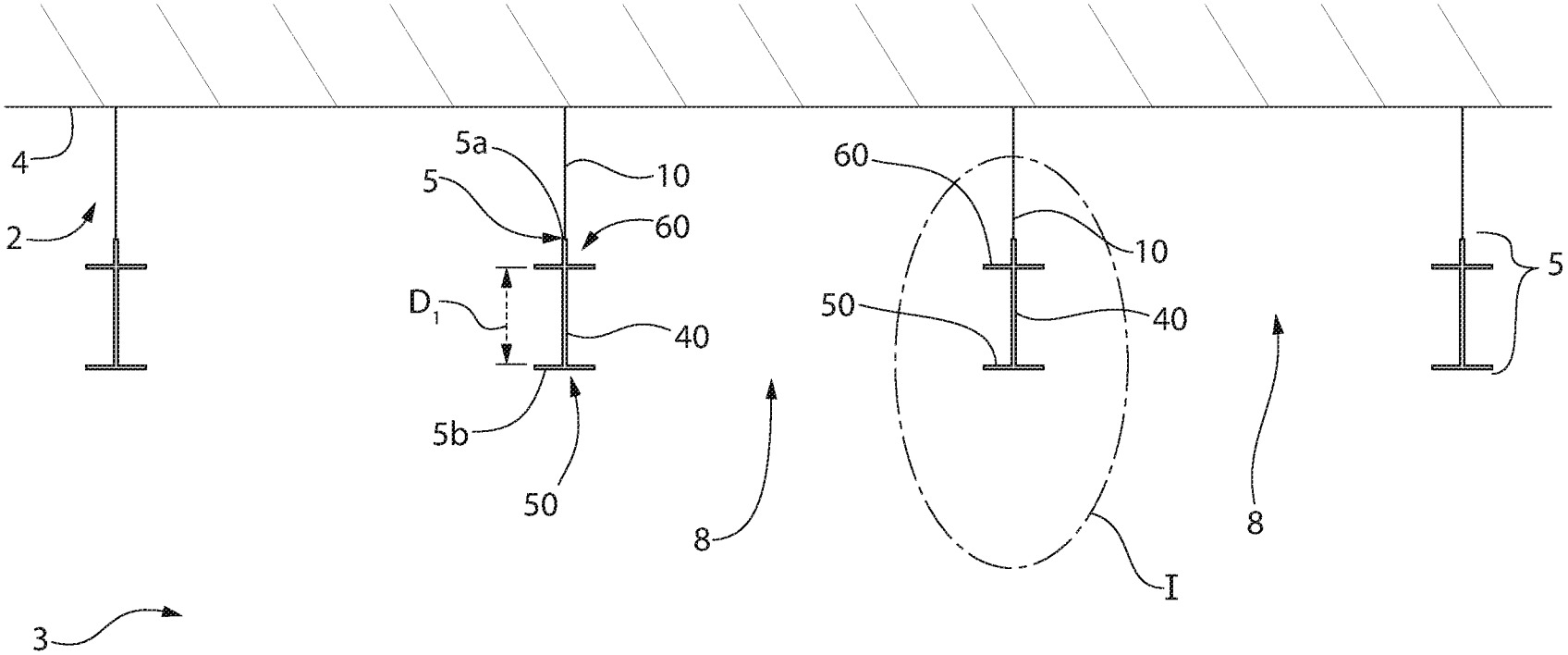
FIG. 6 is a side view of the ceiling grid of FIG. 1.
Figure 7:
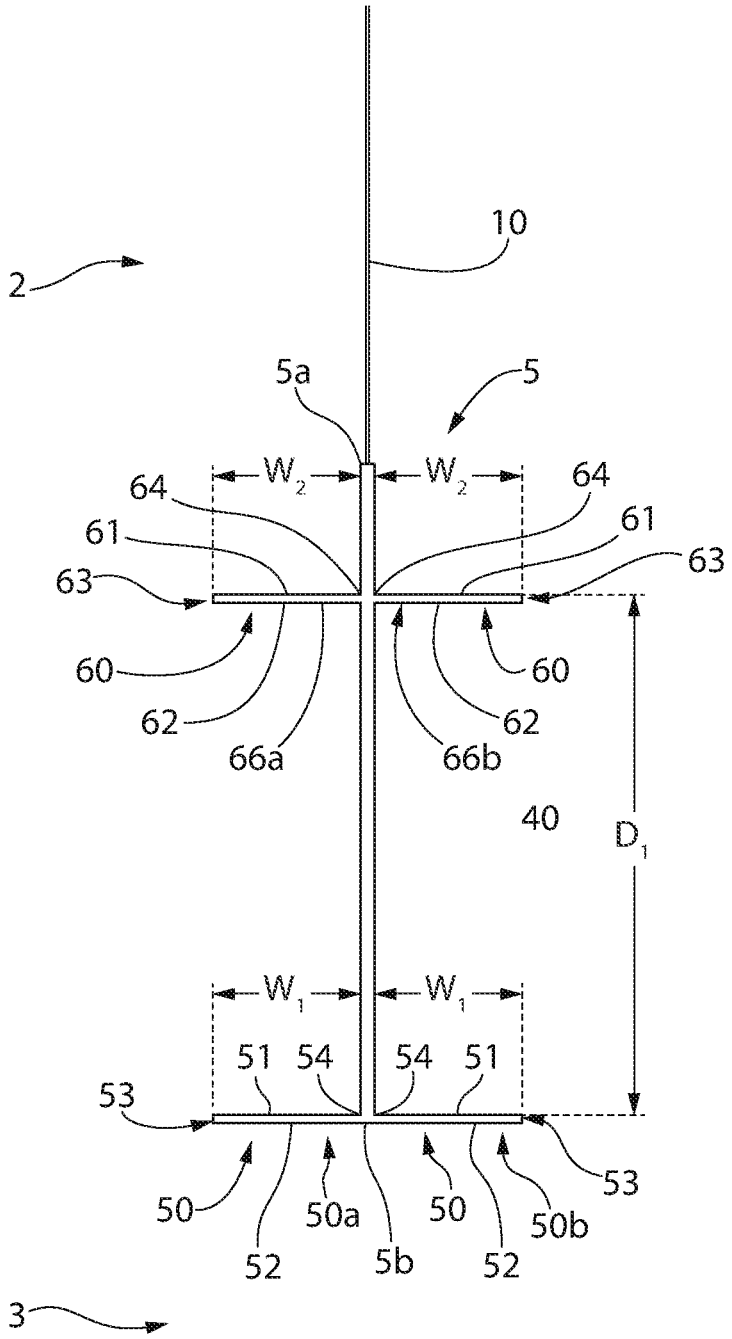
FIG. 7 is a close-up of region I of FIG. 6.
Figure 8:
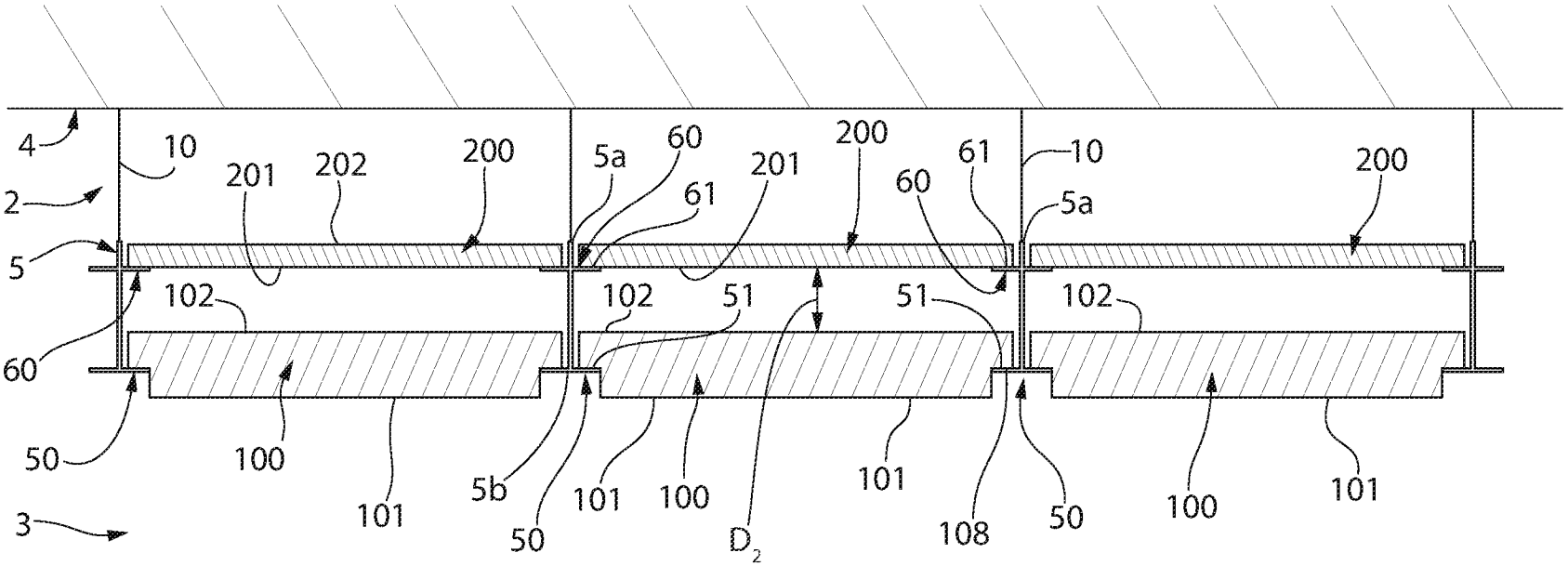
FIG. 8 is a side view of the fully installed ceiling system of FIG. 3.

Referring now to FIGS. 6-8, the support grid 5 may have a top portion 5*a* opposite a bottom portion 5*b*. The support grid 5 may be suspended from one or more supports 10 that extends from the top portion 5*a* of the support grid 5 to the roof or subfloor 4. In a non-limiting example, the support 10 may be a cable secured to both the roof or subfloor 4 and the top portion 5*a* of the support grid 5. In other embodiments of the present invention, the support grid 5 may be supported by wall-mounted hardware—not pictured.

The support grid 5 may be formed by a plurality of first support members 6 and plurality of second support members 7. The plurality of first support members 6 may intersect the plurality of second support members 7 to form a plurality of grid openings 8. The grid openings 8 may extend from the top portion 5*a* to the bottom portion 5*b* of the support grid 5. The plurality of first support members 6 may intersect the plurality of second support members 7 at a right angle to form a plurality of rectangular grid openings 8. In other embodiments, the plurality of first support members 6 may intersect the plurality of second support members 7 at an oblique angle to form a plurality of non-right angle quadrilateral grid openings 8.

At least one of the first support member 6 and the second support member 7 may comprise a vertical web 40, a first support 50, and a second support 60. The first support 50 is vertically offset from the second support by a first offset distance $D_1$. The first offset distance $D_1$ is a positive, non-zero value. The first support 50 may be located beneath the second support 60 by the first offset distance $D_1$. The first support 50 may be located directly beneath the second support 60 by the first offset distance $D_1$. The first offset distance $D_1$ may range from about 0.25 inches to about 6.0 inches—including all distances and sub-ranges there-between.

In a non-limiting embodiment, the first support 50 may be a first horizontal flange, whereby the first support 50 may comprise an upper surface 51 opposite a lower surface 52. The upper surface 51 of the first support 50 may also be referred to as a first support surface 51, which faces toward the plenary space 2. The lower surface 52 of the first support 50 may face downward toward the active room area 3.

The first horizontal flange may extend laterally outward from a proximal end 54 to a distal end 53 to define a first support width $W_1$ of the first support 50. The proximal end 54 of the first support 50 may be located where the first horizontal flange meets the vertical web 40, and the distal end 53 of the first support 50 may be located where the first horizontal flange terminates laterally outward.

The first support 50 may extend between the distal end 53 and the proximal end 54 by a first support width $W_1$. The first support width $W_1$ may range from about 0.125 inches to about 3.0 inches—including all widths and sub-ranges there-between.

The first support 50 of the support grid 5 may comprise a first one 50*a* of the first support 50 and a second one 50*b* of the first support 50, whereby the first one and second one 50*a*, 50*b* of the first support 50 extend out laterally from the vertical web 40 in opposite directions.

In a non-limiting embodiment, the second support 60 may be a second horizontal flange, whereby the second support 60 may comprise an upper surface 61 opposite a lower surface 62. The upper surface 61 of the second support 60 may also be referred to as a second support surface 61, which faces toward the plenary space 2. The lower surface 62 of the second support 60 may face downward toward both the first support 50 and the active room area 3. The first vertical offset distance $D_1$ may be the distance measured between the first support surface 51 and the second support surface 61.

The second horizontal flange may extend laterally outward from a proximal end 64 to a distal end 53 to define a second support width $W_2$ of the second support 60. The proximal end 64 may be located where the second horizontal flange meets the vertical web 40 and the distal end 63 of the second support 60 may be located where the second horizontal flange terminates laterally outward.

The second support width $W_2$ may range from about 0.125 inches to about 2.0 inches—including all widths and sub-ranges there-between. The first and second support widths $W_1$, $W_2$ may be substantially equal. In other embodiments, the first support width $W_1$ may be greater than the second support width $W_2$. In other embodiments, the first support width $W_1$ may be less than the second support width $W_2$.

The second support 60 of the support grid 5 may comprise a first one 60*a* of the second support 60 and a second one 60*b* of the second support 50, whereby the first one and second one 60*a*, 60*b* of the second support 60 extend out laterally from the vertical web 40 in opposite directions.

In some embodiments, the second support surface 62 may be formed by the top portion 5*a* of the support grid 5. In other embodiments, the second support surface 62 may be vertically offset below the top portion 5*a* of the support grid 5.

In some embodiments, the first support 50 may be integrally formed with the vertical web 40. In other embodiments, the first support 50 may be a separate hardware component that is fastened onto vertical web 40 by either a separate fastener or by a snap fit of the first support 50 onto the vertical web 40.

In some embodiments, the second support 60 may be integrally formed with the vertical web 40. In other embodiments, the second support 60 may be a separate hardware component that is fastened onto vertical web 40 by either a separate fastener or by a snap fit of the second support 60 onto the vertical web 40.

In other embodiments, the first support 50 may be a tab, clip, or other hardware configured to support the first panel 100 in a vertical direction—as discussed in greater detail herein. In other embodiments, the second support 60 may be a tab, clip, or other hardware configured to support the second panel 200 in a vertical direction—as discussed in greater detail herein.

Figure 4:
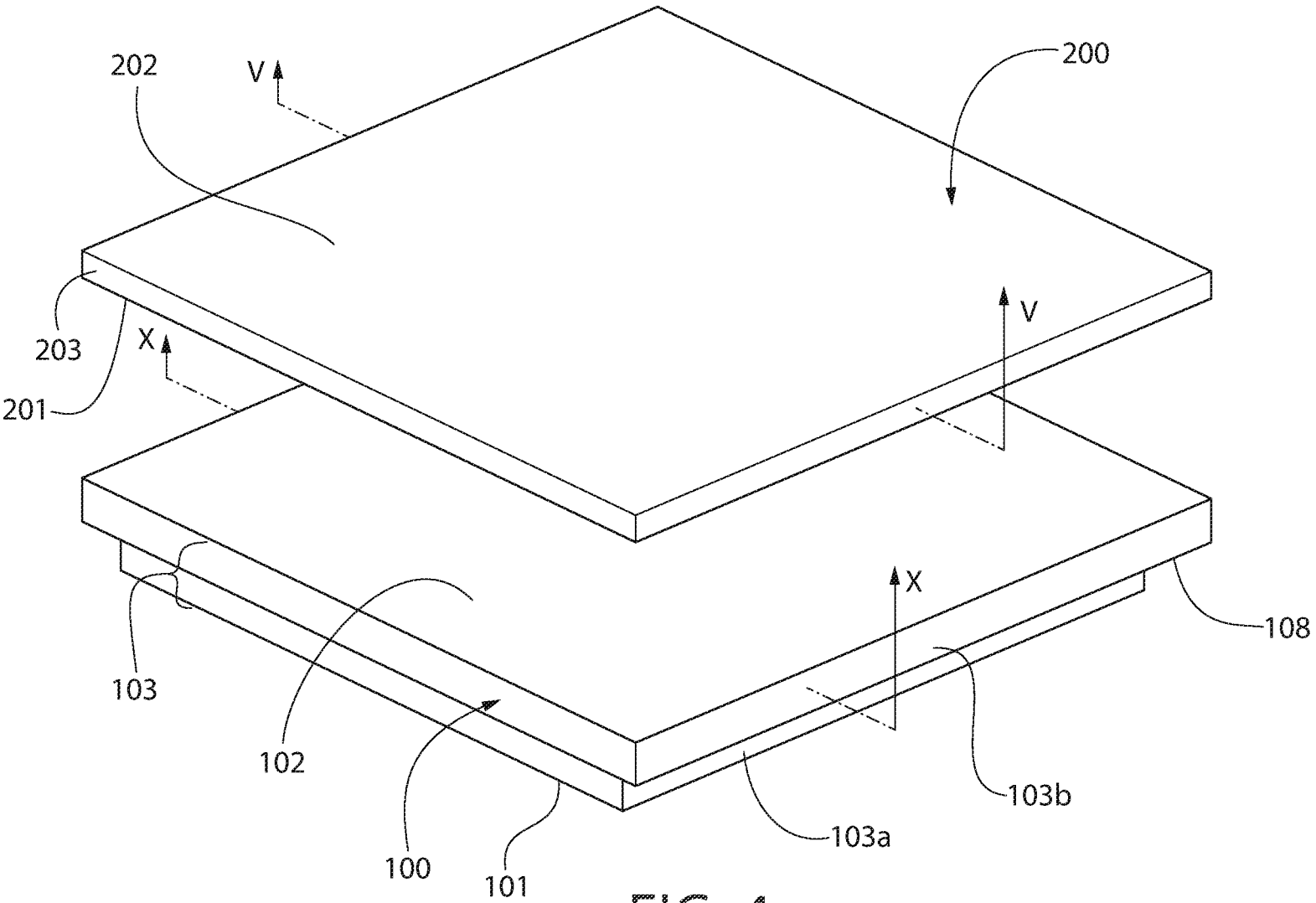
FIG. 4 is a top perspective view of a first building panel and a second building panel that form part of the fully installed ceiling system of FIG. 3.
Figure 5:
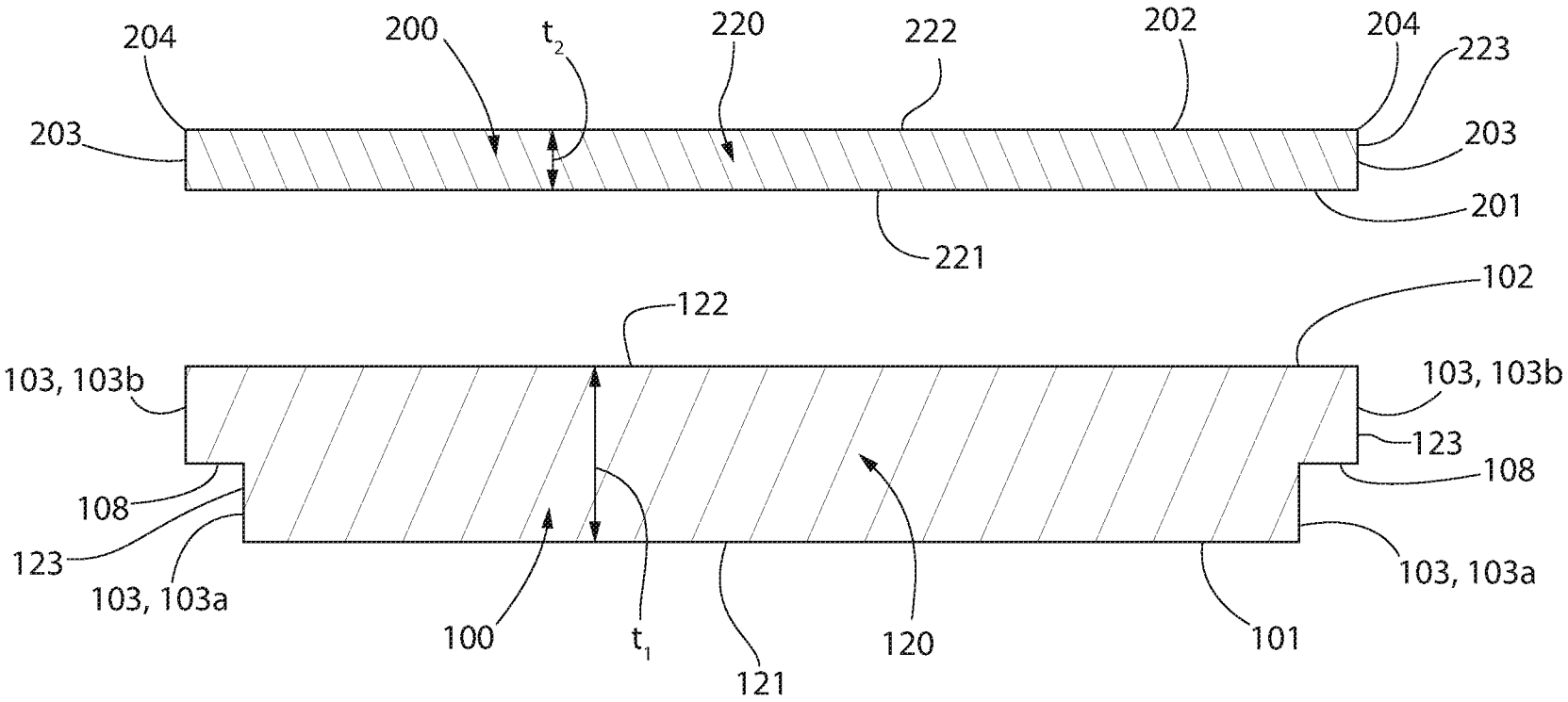
FIG. 5 is cross-sectional view of the first building panel along line V-V of FIG. 4 and the second building panel along line X-X of FIG. 4.

Referring now to FIGS. 4 and 5, the first panel 100 may comprise a first exposed major surface 101 opposite a second exposed major surface 102. The first panel 100 may further comprise an exposed side surface 103 extending between the first and second exposed major surfaces 101, 102.

The first panel 100 may have a first overall length and a first overall width. In some embodiments, the first overall length of the first panel 100 may range from about 12 inches to about 96 inches—including all lengths and sub-ranges there-between. In a non-limiting example, the first overall length may be 12, 18, 24, 30, 48, 60, 72, or 96 inches. In some embodiments, the first overall width of the first panel 100 may range from about 4 inches to about 48 inches—including all widths and sub-ranges there-between. In a non-limiting example, the first overall width may be 4, 6, 12, 18, 20, 24, 30, or 48 inches.

The second exposed major surface 102 of the first panel 100 may have a length and a width. The first exposed major surface 101 of the first panel 100 may have a length and a width. In some embodiments each of the lengths and widths of the first and second exposed major surfaces 101, 102 of the first panel 100 may be substantially equal to the overall length and widths of the first panel 100.

In some embodiments the length of the second exposed major surface 102 and the first exposed major surface 101 are substantially equal. In some embodiments the width of the second exposed major surface 102 and the first exposed major surface 101 are substantially equal. In some embodiments the length of the second exposed major surface 102 is greater than the length of the first exposed major surface 101. In some embodiments the width of the second exposed major surface 102 is greater than the width of the first exposed major surface 101.

In some embodiments of the present invention, the exposed side surface 103 of the first panel 100 may comprise a stepped profile having an upper side surface 103*b* and a lower side surface 103*a*. An intermediate surface 108 extends between the lower side surface 103*a* and the upper side surface 103*b* in a direction that is substantially perpendicular to the exposed side surface 103, the upper side surface 103*a*, and the lower side surface 103*b* of the first panel 100. In some embodiments, the intermediate surface 108 faces the same direction as the first exposed major surface 101 of the first panel 100. In other embodiments, the intermediate surface 108 may face a direction oblique to the first exposed major surface 101 of the first panel 100.

The stepped profile comprises the combination of the upper side surface 103*b*, the intermediate surface 108, and the lower side surface 103*a*. According to this embodiment, the second exposed major surface 102 of the ceiling panel 100 has a surface area that is greater than a surface area of the first exposed major surface 101 of the first panel 100. In some embodiments the surface area of the second exposed major surface 102 of the first layer 100 is equal to the sum of the area of the first exposed major surface 102 and the surface area of the intermediate surface 108 of the first panel 100. According to this embodiment, at least one of the width and length of the second exposed major surface 101 of the first panel 100 is less than the length and the width of the second exposed major surface 102 of the first panel 100.

In some embodiments, the first panel 100 comprising the stepped profile will have at least one of the length or width of the first exposed major surface 101 be less than the length or the width of the second exposed major surface 102 by a distance ranging from about 0.5 inches to about 2 inches.

In some embodiments, the stepped profile of the first panel 100 may be present on each of the exposed side surfaces 103 of the ceiling panel 100. In other embodiments, the stepped profile may only be present on two opposite exposed side surfaces 103 of the first panel 100. In a preferred embodiment, the first exposed major surface 101 of the first panel 100 directly faces the active room area 3—as shown in FIG. 8.

The first panel 100 may comprise a first body 120 having a first major surface 121 opposite a second major surface 122 and a side surface 123 extending there-between. The first body 120 may be air-permeable (also referred to as a "first air-permeable body"). The second exposed major surface 102 of the first panel 100 may comprise the second major surface of the first body 120.

The first panel 100 may further comprise a scrim (not pictured). The scrim may be a non-woven scrim formed of a fibrous material—such as fiber glass. The scrim may be adhesively bonded to the first major surface 121 of the first body 120. In such embodiments, the first exposed major surface 101 of the first panel 100 may be formed by the scrim. In other embodiments, the scrim may be omitted such that the first exposed major surface 101 of the first panel 100 is formed by the first major surface 121 of the first body 120.

The first body 120 may have an overall length and an overall width. The overall length of the first body 120 may be substantially equal to the overall length of the first panel 100. The overall width of the first body 120 may be substantially equal to the overall width of the first panel 100.

The side surface 123 of the first body 120 may form the exposed side surface 103 of the first panel 100—including the stepped profile that comprises the upper side surface 103*b*, the lower side surface 103*a*, and the intermediate surface 108.

The first body 120 may have a first thickness $t_1$ as measured by the distance between the first and second major surfaces 121, 122 of the first body 120. The first thickness $t_1$ may range from about 0.25 inches to about 3.0 inches—including all thickness and sub-ranges there-between. The first panel 100 may also have a thickness as measured between the first exposed major surface 101 and the second exposed major surface 102. The thickness of the first panel 100 may be substantially equal to the first thickness $t_1$ of the first body 120 plus any thickness of the scrim (if present).

The first body 120 may be a porous structure. The term "porous structure" refers to the first body 120 comprising a plurality of open pathways that extend between a plurality of first openings present on the first major surface 121, a plurality of second openings present on the second major surface 122. The open pathways allow for air to flow through the first body 100 thereby making it air-permeable under atmospheric conditions. The open pathways of the first body 120 may not be limited in ultimate distance or how tortuous the pathway may be between the first major surface 121 and the second major surface 122 other than no line of visible sight exists between the first major surface 121 and the second major surface 122 of the first body 120. Stated otherwise, the first body 120 may be semi-transparent with respect to airflow between the first major surface 121 and the second major surface 122, but the first body 120 is also opaque with respect to visible light between the first major surface 121 and the second major surface 122 of the first body 120. The phrase "semi-transparent with respect to airflow" refers to the open pathways creating fluid communication between the various referenced points within the first body 120.

The first body 120 may comprise a fibrous material. The first body 120 may comprise a filler. The first body 120 may comprise a binder.

The fibrous material may comprise an organic fiber. Non-limiting examples of organic fiber include cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof.

The fibrous material may comprise an inorganic fiber. Non-limiting examples of inorganic fiber include fiberglass, mineral wool (also referred to as slag wool), rock wool, stone wool, and glass fibers (fiberglass).

Depending on the specific type of material, the fibrous material may either be hydrophilic (e.g., cellulosic fibers) or hydrophobic (e.g. fiberglass, mineral wool, rock wool, stone wool). The fibrous material may be present in an amount ranging from about 5 wt. % to about 99 wt. % based on the total dry weight of the first body 120—including all values and sub-ranges there-between.

The phrase "dry-weight" refers to the weight of a referenced component without the weight of any carrier. Thus, when calculating the weight percentages of components in the dry-state, the calculation should be based solely on the solid components (e.g., binder, filler, fibrous material, etc.) and should exclude any amount of residual carrier (e.g., water, VOC solvent) that may still be present from a wet-state, which will be discussed further herein. According to the present invention, the phrase "dry-state" may also be used to indicate a component that is substantially free of a carrier, as compared to the term "wet-state," which refers to that component still containing various amounts of carrier—as discussed further herein. The dry-state may refer to the coatings having a solids content of at least about 99 wt. % based on the total weight of the coating—such amount may allow for minor amounts (up to about 1 wt. %) of residual liquid carrier that may be present in the coating after drying.

Non-limiting examples of binder may include a starch-based polymer, polyvinyl alcohol (PVOH), a latex, polysaccharide polymers, cellulosic polymers, protein solution polymers, an acrylic polymer, polymaleic anhydride, polyvinyl acetate, epoxy resins, or a combination of two or more thereof. The binder may be present in an amount ranging from about 1.0 wt. % to about 25.0 wt. % based on the total dry weight of the first body 120—including all percentages and sub-ranges there-between.

Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 0 wt. % to about 80 wt. % based on the total dry weight of the first body 120—including all values and sub-ranges there-between.

In non-limiting embodiments, the first body 120 may further comprise one or more additives include defoamers, wetting agents, biocides, dispersing agents, flame retardants (such as alumina tri-hydrate), and the like. The additive may be present in an amount ranging from about 0.01 wt. % to about 30 wt. % based on the total dry weight of the first body 120—including all values and sub-ranges there-between.

The first body 120 may have a first density ranging from about 2 lb./ft$^3$ to about 16 lb./ft$^3$—including all densities and sub-ranges there-between.

The first body 120 may be porous and allow for sufficient airflow via the open pathways such that the resulting first body 120 has the ability to reduce the amount of reflected sound in an active room area 3. As discussed in greater detail herein, air may flow into the first body 120 via the first major surface 121, thereby helping dissipate noise from the active room area 3 from which the air originated.

With the first panel 100 formed from the first body 120, the first panel 100 may also be considered porous and allow for sufficient airflow via the open pathways such that the resulting first panel 100 has the ability to reduce the amount of reflected sound in an active room area 3. As discussed in greater detail herein, air may flow into the first panel 100 via the first exposed major surface 101, thereby helping dissipate noise from the active room area 3 from which the air originated.

The reduction in amount of reflected sound in a room is expressed by a Noise Reduction Coefficient (NRC) rating as described in American Society for Testing and Materials (ASTM) test method C423. This rating is the average of sound absorption coefficients at four ¼ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The first panel 100 may exhibits an NRC of at least about 0.5 as measured between the first and second exposed major surfaces 101, 102. In a preferred embodiment, the first panel 100 of the present invention may have an NRC ranging from about 0.60 to about 0.99—including all value and sub-ranges there-between—as measured between the first and second exposed major surfaces 101, 102 of the first panel 100. Non-limiting examples of NRC value for the first air-permeable body include 0.65, 0.7, 0.75, 0.8, 0.85, 0.9, 0.95—as measured between the first and second major surfaces 101, 102 of the first air-permeable body.

The first panel 100 may have a first airflow resistance ($R_1$) that is measured through the first panel 100 at the first exposed major surface 101 (or the second exposed major surface 102). Airflow resistance is a measured by the following formula:

$$R=(P_A-P_{ATM})/\dot{V}$$

Where R is air flow resistance (measured in ohms); $P_A$ is the applied air pressure; $P_{ATM}$ is atmospheric air pressure; and V is volumetric airflow. The first airflow resistance ($R_1$) of the first panel 100 may range from about 0.5 ohm to about 50 ohms. In a preferred embodiment, the airflow resistance of the first panel 100 may range from about 0.5 ohms to about 35 ohms.

The first body 120 may have a porosity ranging from about 60% to about 98% —including all values and sub-ranges there between. In a preferred embodiment, the first body 120 may have a porosity ranging from about 75% to 95% —including all values and sub-ranges there between. According to the present invention, porosity refers to the following:

$$\%\ \text{Porosity}=[V_{Total}-(V_{Binder}+V_{Fibers}+V_{Filler})]/V_{Total}$$

Where $V_{Total}$ refers to the total volume of the first body 120 as defined by the first major surface 121, the second major surface 122, and the side surfaces 123. $V_{Binder}$ refers to the total volume occupied by the binder in the first body 120. $V_{Fibers}$ refers to the total volume occupied by the fibrous material in the first body 120. $V_{Filler}$ refers to the total volume occupied by the filler in the first body 120. Thus, the % porosity represents the amount of free volume within the first body 120—whereby the free volume forms the open pathways of the first body 120. Thus, as porosity increases, the resulting airflow resistance of the first body 120 decreases and NRC value increases.

The ceiling system 1 further comprises a second panel 200. The second panel 200 may comprise a first exposed major surface 201 opposite a second exposed major surface 202. The second panel 200 may further comprise an exposed side surface 203 extending between the first and second exposed major surfaces 201, 202.

The second panel 200 may have a second overall length and a second overall width. In some embodiments, the second overall length of the second panel 200 may range from about 12 inches to about 96 inches—including all lengths and sub-ranges there-between. In a non-limiting example, the second overall length may be 12, 18, 24, 30, 48, 60, 72, or 96 inches. In some embodiments, the second overall width of the second panel 200 may range from about 4 inches to about 48 inches—including all widths and sub-ranges there-between. In a non-limiting example, the second overall width may be 4, 6, 12, 18, 20, 24, 30, or 48 inches.

The second overall length of the second panel 200 may be substantially equal to the first overall length of the first panel 100. The second overall length of the second panel 200 may be less than the first overall length of the first panel 100. The second overall length of the second panel 200 may be greater than the first overall length of the first panel 100.

The second overall width of the second panel 200 may be substantially equal to the first overall width of the first panel 100. The second overall width of the second panel 200 may be less than the first overall width of the first panel 100. The second overall width of the second panel 200 may be greater than the first overall width of the first panel 100.

The second panel 200 may comprise a second body 220 having a first major surface 221 opposite a second major surface 222 and a side surface 223 extending there-between. The second body 220 may be sound-attenuating. The first exposed major surface 201 of the second panel 200 may comprise the first major surface 221 of the second body 220—meaning that the first major surface 221 of the second body 220 may form the first exposed major surface 201 of the second panel 200. The second exposed major surface 202 of the second panel 200 may comprise the second major surface 222 of the second body 220—meaning that the second major surface 222 of the second body 220 may form the second exposed major surface 202 of the second panel 200. The exposed side surface 203 of the second panel 200 may comprise the side surface 223 of the second body 220—meaning that the side surface 223 of the second body 220 may form the exposed side surface 203 of the second panel 200.

The second body 220 may have an overall length and an overall width. The overall length of the second body 120 may be substantially equal to the overall length of the second panel 200. The overall width of the second body 220 may be substantially equal to the overall width of the second panel 200.

The overall length of the first panel 100 may be substantially equal to the overall length of the second panel 200. The overall width of the first panel 100 may be substantially equal to the overall width of the second panel 200. In other embodiments, the overall lengths of the first panel 100 and the second panel 200 may be different. In other embodiments, the overall widths of the first panel 100 and the second panel 200 may be different.

The second body 220 may have a second thickness $t_2$ as measured by the distance between the first and second major surfaces 221, 222 of the second body 220. The second thickness $t_2$ may range from about 0.125 inches to about 2 inches—including all thickness and sub-ranges there-between. The second panel 200 may also have a thickness as measured between the first exposed major surface 201 and the second exposed major surface 202. The thickness of the second panel 200 may be substantially equal to the second thickness $t_2$ of the second body 220.

The second panel 200 may be referred to as an "attenuation layer" and the second body 220 may be referred to as an "attenuation body." The second body 220 may be formed from a sound attenuating material. The sound attenuating material may include one or more of fiberglass, mineral wool (such as rock wool, slag wool, or a combination thereof), synthetic polymers (such as melamine foam, polyurethane foam, or a combination thereof), mineral cotton, silicate cotton, gypsum, or combinations thereof. In some embodiments the sound attenuating material may comprise gypsum board, cement board, granite, and ceramic board.

There may be overlap between the fibrous material that forms the first body 120 and the sound attenuating material that forms the second body 220—however, the term "sound attenuating material" refers reference to such materials being supplied in the second body 220 such that the second body 220 does not exhibit the same air-permeability as the first body 120. Specifically, the second body 220 may comprise the same fibrous material, but the second body 220 includes fewer and/or smaller air flow pathways as compared to that of the first body 120. The result is the second body 220 having a comparatively higher airflow resistance than the first body 120 under atmospheric conditions. Similar to the first body 120, there may be no visible line of sight between the first major surface 221 and the second major surface 222 of the second body 220. Stated otherwise, the second body 220 may be opaque with respect to visible light between the first major surface 221 and the second major surface 222 of the second body 220.

The second body 220 may have a second density ranging from about 16 lb./ft$^3$ to about 180 lb./ft$^3$—including all densities and sub-ranges there-between. In a preferred embodiment, the second body 220 may have a second density ranging from about 25 lb./ft$^3$ to about 100 lb./ft$^3$ including all densities and sub-ranges there-between.

A ratio of the second density of the second body 220 to the first density of the first body 120 may range from about 1.5:1 to about 10:1—including all densities and sub-ranges there-between. In a preferred embodiment, the ratio of the second density of the second body 220 to the first density of the first body 120 may be at least 2:1, preferably 3:1.

The second panel 200, when installed in a ceiling grid 5, may result in a ceiling system 1 that exhibits a CAC value of at least 35 db, preferably at least 50 db.

Referring now to FIGS. 1-3 and 8, the ceiling system 1 of the present invention may be formed by installing a ceiling grid 5 within a room, thereby diving the room into the plenary space 2 and the active room area 3. A first panel 100 and a second panel 200 may be installed such that the first panel 100 is supported by the first support 50 of the ceiling grid 5 and the second panel 200 is supported by the second support 60 of the ceiling grid 5. According to the present invention, the first panel 100 may be installed onto the ceiling grid 5 before the second panel 200. In other embodiments, the second panel 200 may be installed onto the ceiling grid 5 before the first panel 100. In some embodiments, the first panel 100 and the second panel 200 may be installed onto the ceiling grid 5 simultaneously.

The first panel 100 may be installed onto the ceiling grid 5 to form part of the ceiling system 1 by inserting the first panel 100 into one of the grid openings 8 such that the first exposed major surface 101 of the first panel 100 faces the first support surface 51 of the first support 50. The first panel 100 may be inserted upward into the grid opening 8 via the lower portion **5*b* of the support grid 5 from the active room area 3 or may be inserted downward into the grid opening 8 via the upper portion 5*a* of the support grid 5 from the plenary space 2**.

In the installed state, the first panel 100 may be mounted to the ceiling grid 5 such that the first support surface 51 supports the first exposed major surface 101 of the first panel 100. In the installed state, the first panel 100 may be supported within the ceiling grid 5 such that the first support surface 51 contacts the perimeter portion of the first exposed major surface 101 of the first panel 100. In the installed state, the first exposed major surface 101 of the first panel 100 faces downward toward the active room area 3 and the second exposed major surface 102 of the first panel 100 faces upward toward the plenary space 2.

According to this embodiment, the second exposed major surface 102 of the first panel 100 is located beneath the top portion **5*a* of the grid support 5. According to this embodiment, the second exposed major surface 102 of the first panel 100 is located beneath the second support 60 of the grid support 5. According to this embodiment, the first exposed major surface 101 of the first panel 100 may located above the bottom portion 5*b* of the grid support 5. According to this embodiment, the first exposed major surface 101 of the first panel 100 may located above the first support 50. According to this embodiment, the first exposed major surface 101 of the first panel 100 may be located above the lower surface 52 of the first support 50. According to this embodiment, the exposed side surface 103 of the first panel 100 may be entirely circumscribed by the first and second support members 6, 7 that define the grid opening 8 in which the first panel 100** is positioned.

According to the embodiments where the first panel 100 comprises the stepped edge profile on the exposed side surface 103, in the installed state, the first panel 100 may be mounted to the ceiling grid 5 such that the first support surface 51 supports the intermediate surface 108 of the exposed side surface 103 of the first panel 100. According to this embodiment, the first panel 100 may be mounted to the ceiling grid 5 such that the first support surface 51 contacts the intermediate surface 108 of the exposed side surface 103 of the first panel 100. In the installed state, the first exposed major surface 101 of the first panel 100 faces downward toward the active room area 3 and the second exposed major surface 102 of the first panel 100 faces upward toward the plenary space 2.

According to this embodiment, the second exposed major surface 102 of the first panel 100 is located beneath the top portion 5*a* of the grid support 5. According to this embodiment, the second exposed major surface 102 of the first panel 100 is located beneath the second support 60 of the grid support 5. According to this embodiment, the first exposed major surface 101 of the first panel 100 may be co-planar with the bottom portion 5*b* of the grid support 5. Alternatively, the first exposed major surface 101 of the first panel 100 may extend beneath the bottom portion 5*b* of the grid support 5. According to this embodiment, the upper side surface 103*b* of the first panel 100 may be circumscribed by the first and second support members 6, 7 that define the grid opening 8 in which the second panel 100 is positioned. According to this embodiment, at least a portion of the lower side surface 103*a* of the exposed side surface 103 of the first panel 100 may be located beneath the first and second support members 6, 7 that define the grid opening 8 in which the first panel 100 is positioned.

The second panel 200 may be installed onto the ceiling grid 5 to form part of the ceiling system 1 by inserting the second panel 100 into one of the grid openings 8 that is to be share with the first panel 100. The second panel 200 may be installed such that the first exposed major surface 201 of the second panel 200 faces downward toward the second support surface 61 of the second support 60. The second panel 200 may be inserted upward into the grid opening 8 via the lower portion 5*b* of the support grid 5 from the active room area 3 or may be inserted downward into the grid opening 8 via the upper portion 5*a* of the support grid 5 from the plenary space 2.

In the installed state, the second panel 200 may be mounted to the ceiling grid 5 such that the second support surface 61 supports the first exposed major surface 201 of the second panel 200. In the installed state, the second panel 200 may be supported by the ceiling grid 5 such that the second support surface 61 contacts a perimeter portion of the second exposed major surface 201 of the second panel 200. In the installed state, the first exposed major surface 201 of the second panel 200 faces downward toward the active room area 3 and the second exposed major surface 202 of the second panel 200 faces upward toward the plenary space 2. According to this embodiment, the first exposed major surface 201 of the second panel 200 may be located above the lower surface 62 of the second support 60.

According to this embodiment, the second exposed major surface 202 of the second panel 200 is located beneath the top portion 5*a* of the grid support 5. According to this embodiment, the first exposed major surface 201 of the second panel 200 may located above the bottom portion 5*b* of the grid support 5. According to this embodiment, the exposed side surface 203 of the second panel 200 may be entirely circumscribed by the first and second support members 6, 7 that define the grid opening 8 in which the second panel 200 is positioned.

Alternatively, the second panel 200 may have a second thickness $t_2$ such that the first exposed major surface 201 of the second panel is located beneath the top portion 5*a* of the grid support 5 and the second exposed major surface 202 of the second panel 200 is located above the top portion 5*a* of the grid support 5. According to this embodiment, only a portion of the exposed side surface 203 of the second panel 200 may be circumscribed by the first and second support members 6, 7 that define the grid opening 8 in which the second panel 200 is positioned.

Although not pictured, in some embodiments, the top portion 5*a* of the grid support 5 may form the second support 60. In such embodiments, the second panel 200 may be mounted to the ceiling grid 5 such that the first exposed major surface 201 of the second panel 200 faces downward toward the active room area 3 and the second exposed major surface 202 of the second panel 200 faces upward toward the plenary space 2. According to this embodiment, the second panel 200 may sit atop of the top portion 5*a* of the grid support 5, resulting in the second panel 200 being located in the plenary space 2 (as defined by the space located above the support grid 5). According to such embodiments, the exposed side surface 203 of the second panel 200 is not circumscribed by either of the first or second support members 6, 7 that define the grid opening 8 atop which the second panel 200 is positioned.

Once installed, the second exposed major surface 102 of the first panel 100 faces the first exposed major surface 201 of the second panel 200. The second exposed major surface 102 of the first panel 100 is vertically offset from the first exposed major surface 201 of the second panel 200 by a second offset distance $D_2$. The second offset distance $D_2$ is a positive, non-zero value. The second offset distance $D_2$ may range from about 0.1 inches to about 4.0 inches—including all distances and sub-ranges there-between.

The first offset distance $D_1$ is such that a vertical gap exists between the second exposed major surface 102 of the first panel 100 and the first exposed major surface 201 of the second panel 200, thereby causing the second exposed major surface 102 of the first panel 100 and the first exposed major surface 201 of the second panel 200 to not be in direct contact. The second offset distance $D_2$ is such that a vertical gap exists between the second exposed major surface 102 of the first panel 100 and the first exposed major surface 201 of the second panel 200, thereby causing the second exposed major surface 102 of the first panel 100 and the first exposed major surface 201 of the second panel 200 to not be in direct contact. The vertical gap may be substantially equal to the second offset distance $D_2$.

The vertical gap located between the second exposed major surface 102 of the first panel 100 and the first exposed major surface 201 of the second panel 200 may be occupied only by air.

The first offset distance $D_1$ may be independently selected such that the resulting vertical gap between the first and second panels 100, 200 imparts enhanced sound attenuation performance to the resulting ceiling system. The first offset distance $D_1$ may be independently selected such that the resulting vertical gap between the first and second panels 100, 200 imparts enhanced noise reduction performance to the resulting ceiling system.

The second offset distance $D_2$ may be independently selected such that the resulting vertical gap between the first and second panels 100, 200 imparts enhanced sound attenuation performance to the resulting ceiling system. The second offset distance $D_2$ may be independently selected such that the resulting vertical gap between the first and second panels 100, 200 imparts enhanced noise reduction performance to the resulting ceiling system.

The first thickness $t_1$ of the first body 120/first panel 100 may be substantially equal to the second thickness $t_2$ of the second body 220/second panel 200. In other embodiments, the first thickness $t_1$ of the first body 120/first panel 100 may be greater than the second thickness $t_2$ of the second body 220/second panel 200. In other embodiments, the first thickness $t_1$ of the first body 120/first panel 100 may be less than the second thickness $t_2$ of the second body 220/second panel 200.

A ratio of the first thickness $t_1$ to the second thickness $t_2$ may range from about 0.25:1 to about 16:1—including all distances and sub-ranges there-between. In some embodiments, the ratio of the first thickness $t_1$ to the second thickness $t_2$ may range from about 0.5:1 to about 4:1—including all distances and sub-ranges there-between.

A ratio of the first thickness $t_1$ to the first offset distance $D_1$ may range from about 0.125:1 to about 8:1—including all distances and sub-ranges there-between. A ratio of the first thickness $t_1$ to the second offset distance $D_2$ may range from about 0.0625:1 to about 8:1—including all distances and sub-ranges there-between.

A ratio of the second thickness $t_2$ to the first offset distance $D_1$ may range from about 0.03125:1 to about 8:1—including all distances and sub-ranges there-between. A ratio of the second thickness $t_2$ to the second offset distance $D_2$ may range from about 0.03125:1 to about 16:1—including all distances and sub-ranges there-between.

A ratio of the first offset distance $D_1$ to the second offset distance $D_2$ may range from about 1:1 to about 32:1—including all distances and sub-ranges there-between.

The present invention further provides a method of designing and fabricating an acoustical ceiling system. In a first step, assessing a first room environment for a first noise-reduction performance and a first sound attenuation performance. In an optional second step, a second room environment may also be assessed for a second noise-reduction performance and a second sound attenuation performance.

The assessment of the noise reduction performance and the noise attenuation performance may be based on factors that include the size of the room environment—including the size of the active room area 3, the size of the plenary space 2, the materials that form the active room area 3 (e.g., hardwood floors, carpeted floors, the presence of windows and window treatments, etc.), the purpose of the active room area (e.g., study room or library vs. lecture hall vs. gymnasium).

The method of designing and fabricating the ceiling system further comprises: creating a first parameter that is based on the first vertical offset distance $D_1$ between the first support 50 and a second support 60 of the ceiling grid 5; creating a second parameter that is based on the selection of the first panel 100—which may include the first thickness $t_1$, material used to form the first body 120, the porosity and/or airflow resistance; creating a third parameter that is based on the selection of the second panel 200—which may include the second thickness $t_2$, material used to form the second body 220, and/or airflow resistance; and creating a fourth parameter based on the second vertical offset distance $D_2$ between the second exposed major surface 102 of the first panel 100 and the first exposed major surface 201 of the second panel 200.

Based on the first assessment of the first noise reducing performance and the first sound attenuation performance, adjusting at least one of the first parameter, the second parameter, the third parameter, and the fourth parameter to arrive at a modified ceiling system design. In some embodiments, based on the second assessment of the first noise reducing performance and the first sound attenuation performance, further adjusting at least one of the first parameter, the second parameter, the third parameter, and the fourth parameter to arrive at the modified ceiling system design. Subsequently, fabricating the ceiling grid 5 according to the modified ceiling system design.

Figure 9:
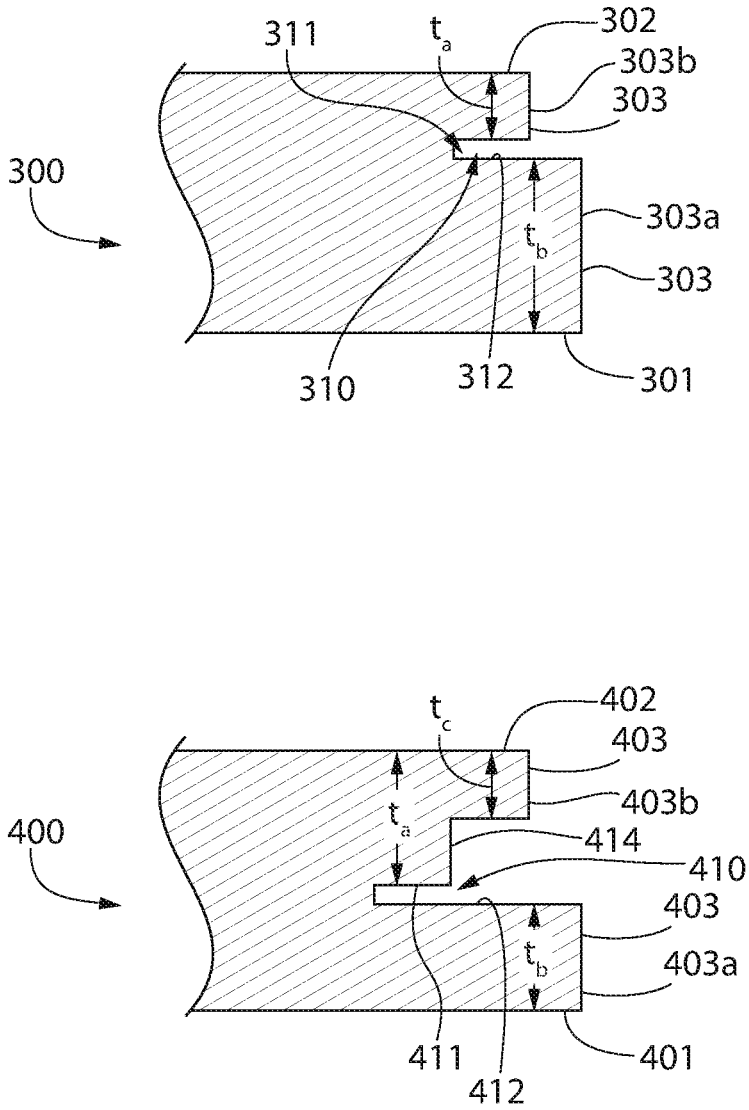
FIG. 9 is a side view depicting panels of the present invention.
Figure 10:
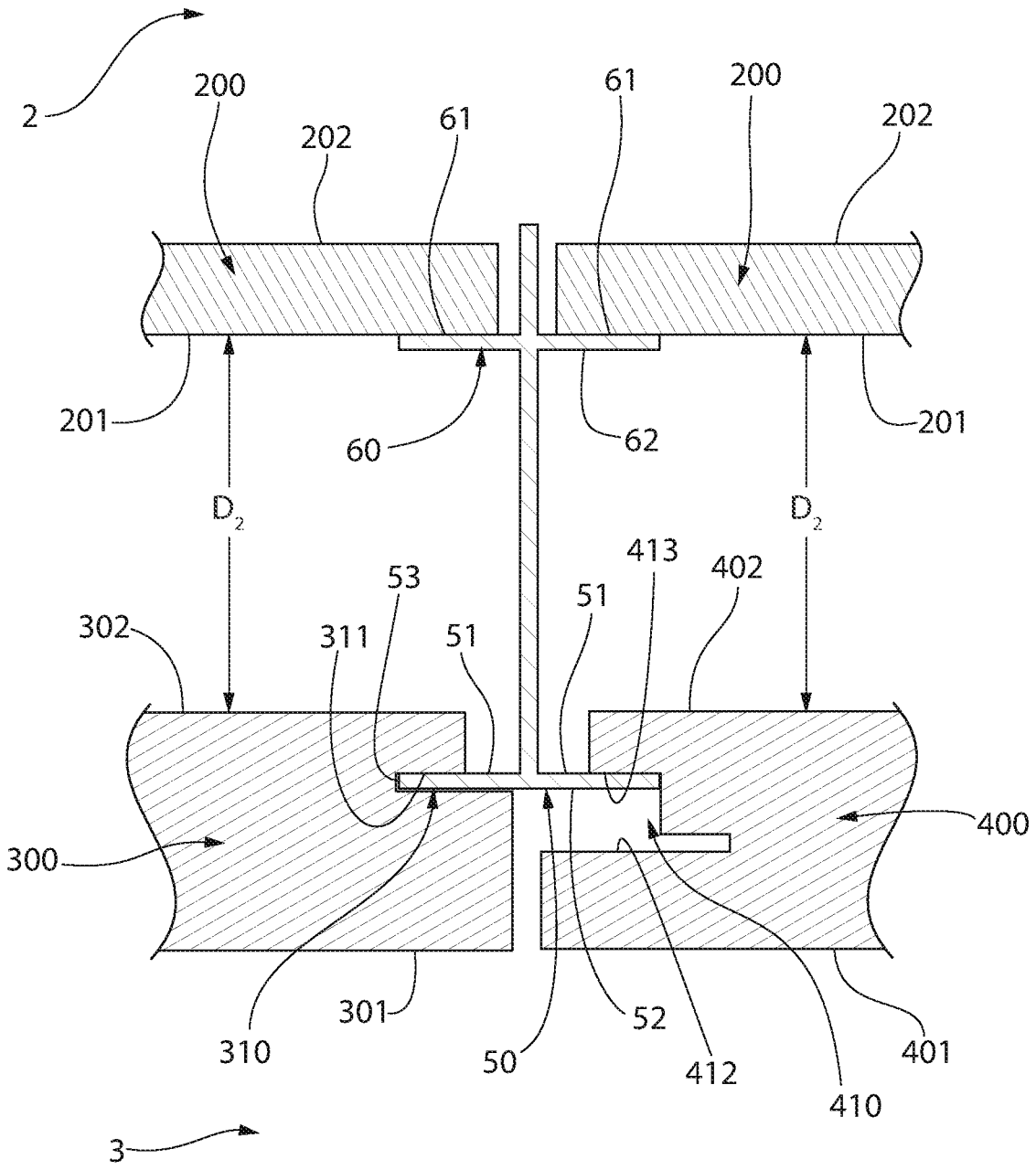
FIG. 10 is a side view depicting a panel within a ceiling system.

Referring now to FIGS. 9 and 10, a first panel 300 is illustrated in accordance with another embodiment of the present invention. The first panel 300 is similar to the first panel 100 except as described herein below. The description of the first panel 100 above generally applies to the first panel 300 described below except with regard to the differences specifically noted below. A similar numbering scheme will be used for the first panel 300 as with the first panel 100 except that the 300-series of numbers will be used.

The first panel 300 may have an exposed side surface 303 that may comprise a stepped profile having an upper side surface **303*b* and a lower side surface 303*a*. The lower side surface 303*a* may extend outward from a center point on the first panel 300 to a distance that is greater than a distance from which the upper side surface 303*b* extends from the center point, thereby creating a stepped-profile on the exposed side surface 303 of the first panel 300**.

The stepped-profile may further comprise an intermediate portion 310 located between the lower side surface **303*a* and the upper side surface 303*b*. In some embodiments, the intermediate portion 310 may comprise an intermediate upper surface 311 that is opposite an intermediate lower surface 312. The intermediate upper surface 311 may face the same direction as the first exposed major surface 301 of the first panel 300. The intermediate lower surface 312 may face the same direction as the second exposed major surface 302 of the first panel 300**.

The first panel 300 may have a first intermediate thickness $t_a$ as measured by the distance between the second exposed major surface 302 of the first panel 300 and the intermediate upper surface 311 of the first panel 300. The first intermediate thickness $t_a$ may range from about 0.125 inches to about 1.0 inches including all thickness and sub-ranges there-between.

The first panel 300 may have a second intermediate thickness $t_b$ as measured by the distance between the first exposed major surface 301 of the first panel 300 and the intermediate lower surface 312 of the first panel 300. The second intermediate thickness $t_b$ may range from about 0.5 inches to about 2.0 inches—including all thickness and sub-ranges there-between.

The stepped-profile present on the exposed side surface 303 of the first panel 300 may provide an edge geometry that forms an elongated horizontal slot that is configured to receive at least a portion of the first support 50. Specifically, the exposed side surface 303 of the first panel 300 may be capable of receiving at least a portion of the first support 50 such that the upper surface 51 of the first support 50 contacts the intermediate upper surface 311 of the intermediate portion 310 and the distal end 53 of the first support 50 may inset of at least one of the upper side surface 303*b* and the lower side surface 303*a*. The first panel 300 may be supported by the contact between the upper surface 51 of the first support 50 and the intermediate upper surface 311 of the intermediate portion 310.

When installed into the ceiling system, at least a portion of the first support 50 may be inserted into the intermediate portion 310 of the exposed side surface 303, whereby the first panel 300 conceals at least that portion of the first support 50 when viewing the support grid 5 from the active room area 3. In such embodiments, the first support 50 may be located between the first exposed major surface 301 and the second exposed major surface 302 of the first panel 300. The second intermediate thickness $t_b$ may be the total thickness of the first panel 300 that is located beneath the first support 50.

FIGS. 9 and 10 further illustrate a first panel 400 in accordance with another embodiment of the present invention. The first panel 400 is similar to the first panel 100 and first panel 300 except as described herein below. The description of the first panel 100 and first panel 300 above generally applies to the first panel 400 described below except with regard to the differences specifically noted below. A similar numbering scheme will be used for the first panel 400 as with the first panel 100 and first panel 300 except that the 400-series of numbers will be used.

The first panel 400 may have an exposed side surface 403 that may comprise a stepped profile having an upper side surface 403*b* and a lower side surface 403*a*. The lower side surface 403*a* may extend outward from a center point on the first panel 400 to a distance that is greater than a distance from which the upper side surface 403*b* extends from the center point, thereby creating a stepped-profile on the exposed side surface 403 of the first panel 400.

The stepped-profile may further comprise an intermediate portion 410 located between the lower side surface 403*a* and the upper side surface 403*b*. In some embodiments, the intermediate portion 410 may comprise a first intermediate upper surface 411, a second intermediate upper surface 413, an intermediate side surface 414 that extends between the first intermediate upper surface and the second intermediate upper surface 413, as well an intermediate lower surface 412 that is opposite both the first and second intermediate upper surfaces 411, 413.

The first intermediate upper surface 411 and the second intermediate upper surface 413 may face the same direction as the first exposed major surface 401 of the first panel 400. The intermediate lower surface 412 may face the same direction as the second exposed major surface 402 of the first panel 400. The intermediate side surface 414 may face the same direction as at least one of the lower side surface 403*a* and the upper side surface 403*b*.

The first panel 400 may have a first intermediate thickness $t_a$ as measured by the distance between the second exposed major surface 402 of the first panel 400 and the first intermediate upper surface 411 of the first panel 400. The first intermediate thickness $t_a$ may range from about 0.125 inches to about 1.0 inches—including all thickness and sub-ranges there-between.

The first panel 400 may have a second intermediate thickness $t_b$ as measured by the distance between the first exposed major surface 401 of the first panel 400 and the intermediate lower surface 412 of the first panel 300. The second intermediate thickness $t_b$ may range from about 0.5 inches to about 2.0 inches—including all thickness and sub-ranges there-between.

The first panel 400 may have a third intermediate thickness $t_c$ as measured by the distance between the second exposed major surface 402 of the first panel 400 and the second intermediate upper surface 413 of the first panel 400. The third intermediate thickness $t_c$ may range from about 0.03 inches to about 0.9 inches—including all thickness and sub-ranges there-between.

The stepped-profile of the exposed side surface 403 of the first panel 400 may provide an edge geometry that is configured to receive at least a portion of the first support 50. Specifically, the exposed side surface 403 of the first panel 400 may be capable of receiving at least a portion of the first support 50 such that the upper surface 51 of the first support 50 contacts at least one of the first intermediate upper surface 411 or the second intermediate upper surface 413 of the intermediate portion 410 and the distal end 53 of the first support 50 may inset of at least one of the upper side surface 403*b* and the lower side surface 403*a*. The first panel 400 may be supported by the contact between the upper surface 51 of the first support 50 and the first intermediate upper surface 411 of the intermediate portion 410. In other embodiments, the first panel 400 may be supported by the contact between the upper surface 51 of the first support 50 and the second intermediate upper surface 413 of the intermediate portion 410.

When installed into the ceiling system, at least a portion of the first support 50 may be inserted into the intermediate portion 410 of the exposed side surface 403 such that the first panel 400 conceals at least that portion of the first support 50 when viewing the support grid 5 from the active room area 3. In such embodiments, the first support 50 may be located between the first exposed major surface 401 and the second exposed major surface 402 of the first panel 400. The second intermediate thickness $t_b$ may be the total thickness of the first panel 400 that is located beneath the first support 50.

According to the alternative embodiments of FIGS. 9 and 10, the first offset distance $D_1$ may still be measured between the first support surface 51 of the first support 50 and the second support 61 of the second support 61. According to the alternative embodiments of FIGS. 9 and 10, the second offset distance $D_2$ may still be measured between the second exposed major surface 302, 402 of the first panel 300, 400 and the first exposed major surface 201 of the second panel 200.

According to the alternative embodiments of FIGS. 9 and 10, the first offset distance $D_1$ recited in the embodiments of FIGS. 1-8 may be adjusted to account for the second intermediate thickness $t_b$ of the first panel 300 that is located beneath the first support 50 while the second offset distance $D_2$ of embodiments shown in FIGS. 1-8 may remain substantially the same.

Figure 11:
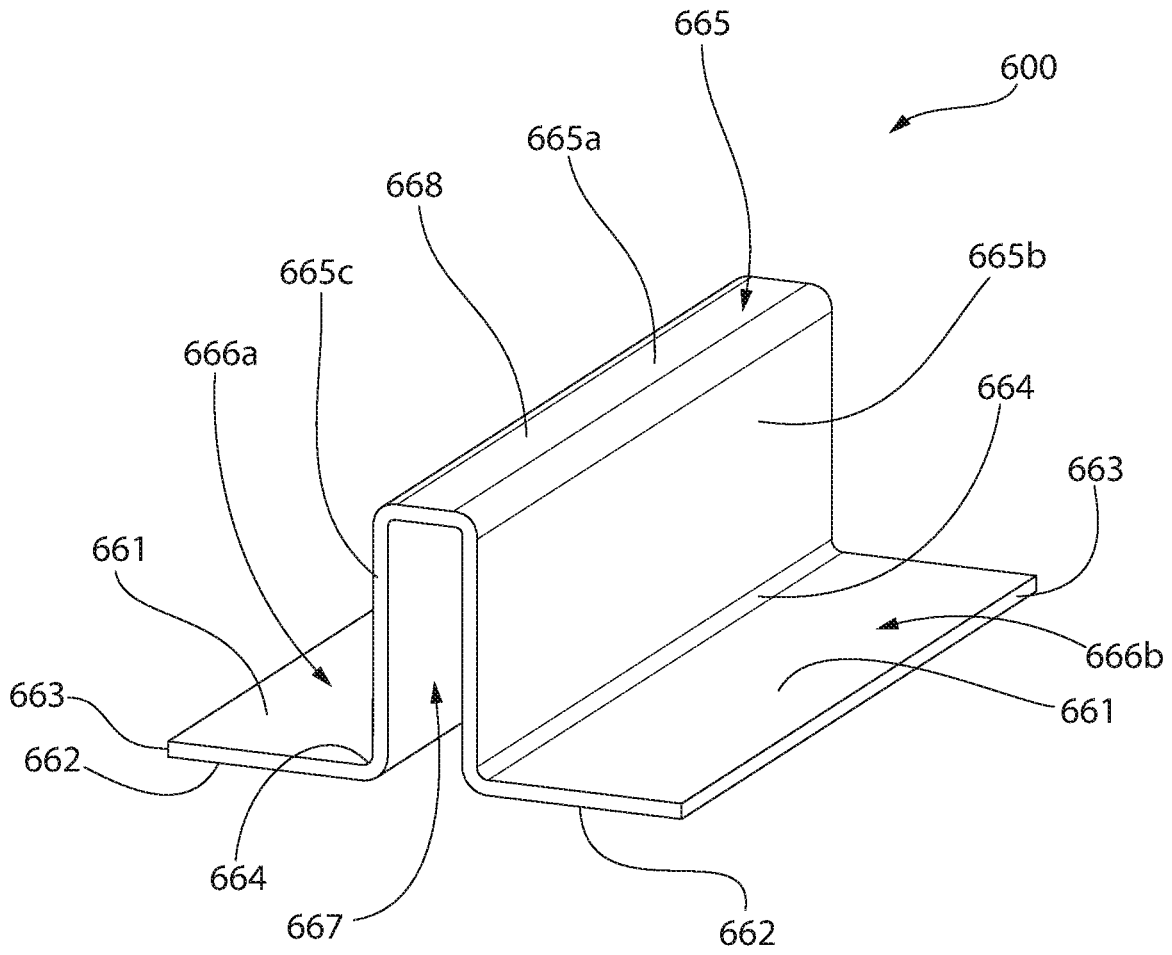
FIG. 11 is a top perspective view of a saddle bracket.
Figure 12:
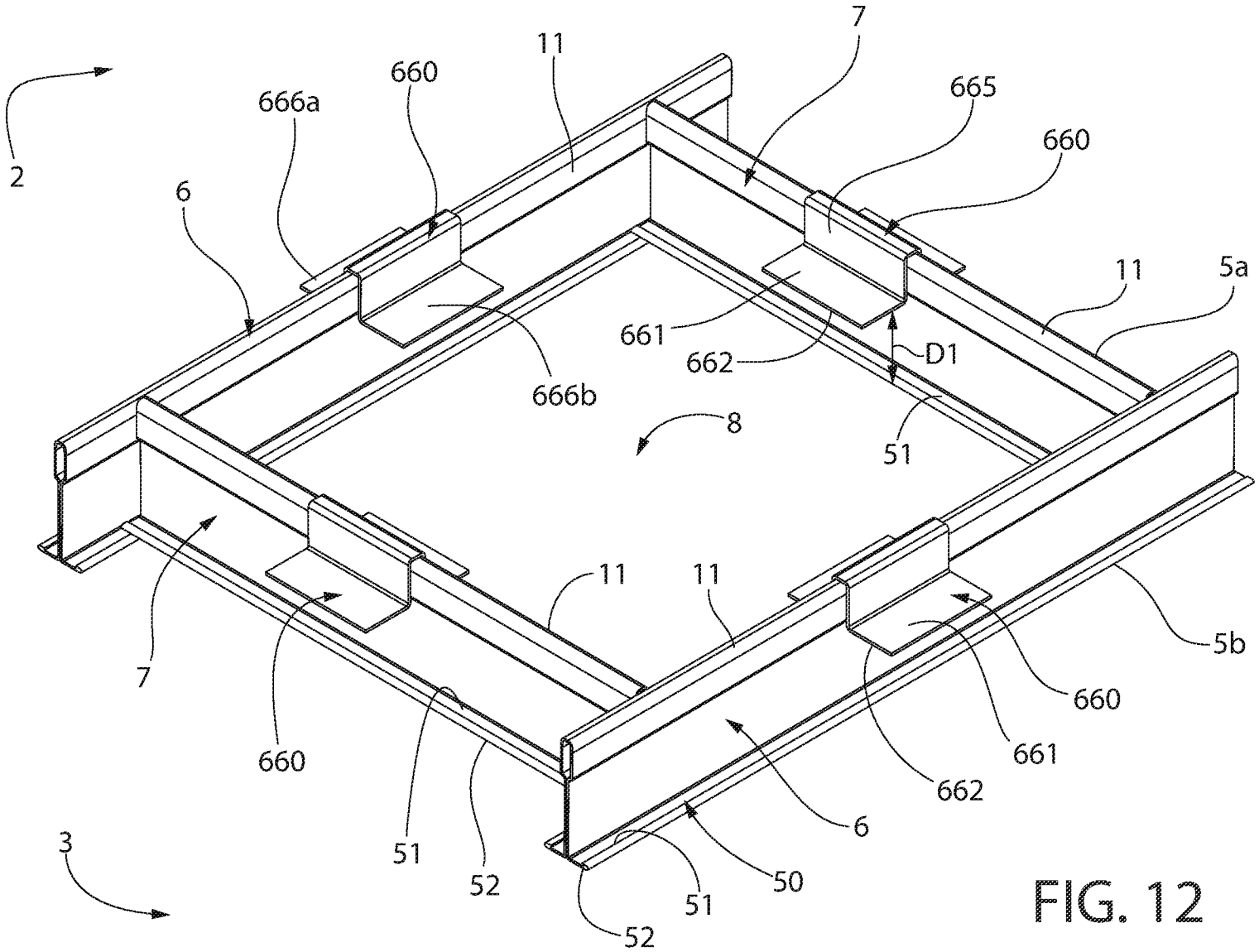
FIG. 12 is a top perspective view of a ceiling system according to certain embodiments of the invention.

Referring now to FIGS. 11 and 12, a second support 660 is illustrated in accordance with another embodiment of the present invention. The second support 660 is similar to the second support 60 except as described herein below. The description of the second support 60 above generally applies to the second support 660 described below except with regard to the differences specifically noted below. A similar numbering scheme will be used for the second support 60 as with the second support 660 except that the 600-series numbers will be used.

According to this embodiment, the second support 660 may be formed as a component that is entirely separate from the support grid 5. In a non-limiting embodiment, the second support 660 may be a saddle bracket. Although not limited to a saddle bracket, for the purposes of the following description, the second support 660 of this embodiment will be referred to as a saddle bracket 660.

The saddle bracket 660 may comprise a body 665 configured for mounting to a top portion 5*a* of a support grid 5. The support grid 5 of this embodiment may not comprise an integrally formed second support 60 as described in the previous embodiments. Rather, the support grid 5 of this embodiment may comprise at least a first and second support member 6, 7, each of which comprise the first support 50, a vertical web 40, and a top stiffening channel 11—whereby the saddle bracket 660 is configured to be mounted to the top stiffening channel 11, as described further herein.

The body 665 of the saddle bracket 660 may comprise an inverted U-shaped central mounting portion 668 configured to engage the bulbous top stiffening channel 11 of the first and second support members 6, 7. The body 665 of the saddle bracket 660 may further comprise a first support flange 666*a* and a second support flange 666*b* extending from a bottom portion of the central mounting portion 668.

The central mounting portion 665 may be comprised of a horizontal top wall 665*a* and pair of opposing and laterally spaced apart vertical sidewalls 665*b*, 665*c* forming a downwardly open receptacle 667 for receiving the stiffening channel 11 of the first and second support members 6, 7. The first support flange 666*a* and the second support flange 666*b* may be arranged on opposing sides of central mounting portion 665 and protrude outwards in opposing lateral (horizontal) directions.

Each of the first and second flanges 666*a*, 666*b* may comprise an upper surface 661 that is opposite a lower surface 662. When mounted to either of the first and/or second support members 6, 7, the upper surface 661 of the first and second flanges 666*a*, 666*b* may face the plenary space 2 and the lower surface 662 of the first and second flanges 666*a*, 666*b* may face the active room area 3. When mounted to either of the first and/or second support members 6, 7, the lower surface 662 of the first and second flanges 666*a*, 666*b* may face the upper surface 51 of the first support 50 of the first and second support members 6, 7. When mounted to either of the first and/or second support members 6, 7, the first offset distance $D_1$ may be measured by the distance between the upper surface 661 of the first and second flanges 666*a*, 666*b* and the upper surface 51 of the first support 50 of the first and second support members 6, 7.

The saddle bracket 660 may be configured to slide in opposing axial directions along one of the first and second support members 6, 7 when mounted thereon. This permits the clip to be located and maintained in a continuum of possible mounting positions along the first and second support members 6, 7.

The saddle bracket 660 may be secured onto one of the first and second support members 6, 7 by a frictional fit between the central mounting portion 665 and the stiffening channel 11. In another embodiment, the saddle bracket 660 may be secured onto one of the first and second support members 6, 7, by a snap-fit between locking tabs present on the saddle bracket and the stiffening channel 11 (not shown).

The saddle bracket 660 may be made of an elastically deformable resilient material to facilitate installing the clip on the first and second support members 6, 7. In non-limiting exemplary embodiments, the spring clip may be made of metal such as without limitation galvanized steel, cold rolled steel, spring steel, stainless steel, aluminum, etc. or non-metal such as a suitable polymer with sufficient strength and flexibility. The U-shaped geometry of the saddle bracket 660 when constructed of such a resilient material allows the opposing flanges 666*a*, 666*b* of the saddle bracket 660 to spread apart horizontally and laterally outwards when the bulbous top stiffening channel 11 is inserted vertically upwards into the receptacle 667 of the first or second support member 6, 7.

In one embodiment, the saddle bracket 660 may have a unitary structure being formed of a single piece of material which may be bent, molded, or otherwise formed to produce the foregoing features of the clip. Accordingly, the flanges 660*a*, 666*b*, sidewalls 665*b*, 665*c*, and top wall 665*a* may be integrally formed as part of the unitary spring clip structure. In other possible embodiments, one or more of these features may be formed as separate elements and assembled in the saddle bracket 660 by any suitable method used in the art (e.g. welding, soldering, fasteners, etc.).

The saddle bracket 660 of the present invention may allow for preexisting ceiling systems to be retrofitted with a second support surface to support the addition of the second panel 200 to the ceiling system 1 in order to achieve the desired acoustical properties.

Figure 13:
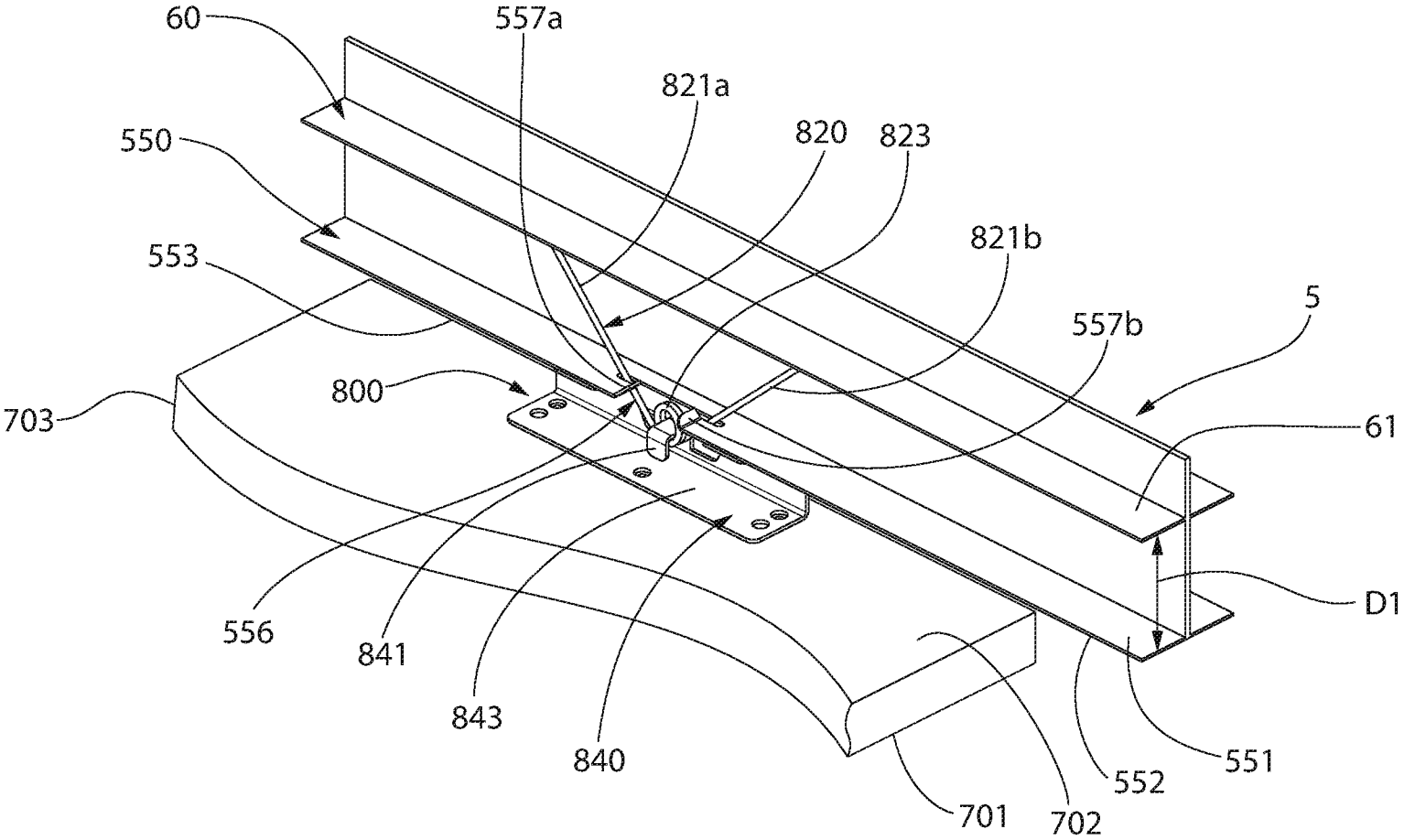
FIG. 13 is a top perspective view depicting a ceiling grid, mounting hardware, and panel of the ceiling system according to certain embodiments of the invention.
Figure 14:
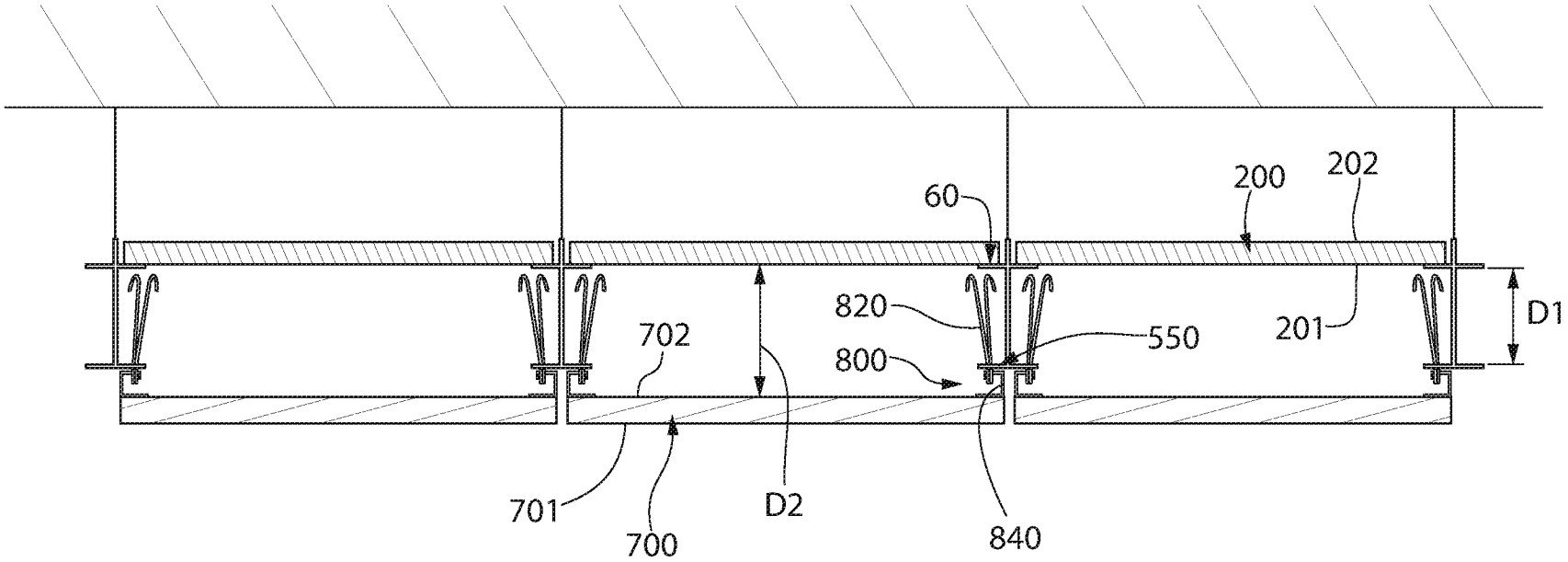
FIG. 14 is a side perspective view depicting a ceiling system according to certain embodiments of the invention.

Referring now to FIGS. 13 and 14, a ceiling system comprising a support member having an alternative first support 550 and alternative first panel 700 is illustrated in accordance with another embodiment of the present invention. The first support 50 is similar to the first support 550 except as described herein below. The description of the first support 50 above generally applies to the first support 550 described below except with regard to the differences specifically noted below. A similar numbering scheme will be used for the first support 50 of FIGS. 1-12 as with the first support 550 of FIGS. 13 and 14 except that the 500-series numbers will be used. Additionally, the first panel 100 is similar to the first panel 700 except as described herein below. The description of the first panel 100 above generally applies to the first panel 700 described below except with regard to the differences specifically noted below. A similar numbering scheme will be used for the first panel 100 of FIGS. 1-8 as with the first panel 700 of FIGS. 13 and 14 except that the 700-series numbers will be used.

According to the embodiment shown in FIGS. 13 and 14, the ceiling system may further comprise mounting hardware 800. The mounting hardware 800 may comprise a torsion spring 820 and a mounting bracket 840. The torsion spring 820 may comprise a coil 823 and two spring legs 821*a*, 821*b* that extend from the coil 823 and may be compressed together.

The mounting bracket 840 may comprise a support plate 843 that is configured to be attached directly or indirectly to the second exposed major surface 702 of the first panel 700. The support plate 843 may be attached directly to the second exposed major surface 702 of the first panel 700 by a fastener extending through the support plate 843 or by an adhesive. The mounting bracket 840 may further comprise an attachment member 841 extending from the support plate 843, whereby the attachment member 841 is configured to couple to the coil 823 of the torsion spring 820. The coil 823 may comprise a through-hole that is configured to receive the attachment member 841, thereby coupling the torsion spring 820 to the mounting bracket 840.

According to the embodiment shown in FIGS. 13 and 14, the first support 550 of the support members 6, 7 may further comprises an elongated slot 556. The elongated slot 556 may accessible via a lateral opening that is formed into the distal end 553 of the first support 550 that extends between two tabs 557*a*, 557*b* on the first support 550. The lateral opening may be configured to receive the two spring legs 821*a*, 821*b* of the torsion spring 820 by compressing the two spring legs

821*a*, 821*b* together, followed by inserting the two compressed spring legs 821*a*, 821*b* through the lateral opening, and subsequently uncompressing the two spring legs 821*a*, 821*b* allowing the two legs 821*a*, 821*b* to expand away from each other until the two legs 821*a*, 821*b* contact portions of the first support 550 that define the elongated slot inset of the first and second labs 557*a*, 557*b*.

The first panel 700 may be indirectly supported by the first support 550 through the connection formed by the mounting bracket 840 being attached to the first panel 700, the torsion spring 820 coupled to the mounting bracket 840, and the torsion spring 820 coupled to the first support 550 via the elongated slot 556. With the first panel 700 attached to the first support 550 by the mounting hardware 800, the first panel 700 may installed and located entirely beneath the first support 550. Specifically, the second exposed major surface 702 of the first panel 700 may be located entirely beneath the lower surface 552 of the first support 550 when coupled to the support grid 5.

Furthermore, with the mounting hardware 800 comprising the torsion spring 820 that has the compressible legs 821*a*, 821*b* as well as the first support 550 comprising the elongated slot 556, the first panel 700 may be configured to be alterable between a first vertical distance relative to the first support and a second distance relative to the first support 550 when coupled to the support grid 5—whereby the first and second vertical distances are not equal.

Specifically, the first panel 700 may be mounted to the support grid 5 at the first vertical distance relative to the first support 550 such that the mounting bracket 840 may contact the first support 550. At the first vertical distance, the first panel 700 may be mounted to the support grid 5 such that the mounting bracket 840 may contact the lower surface 551 of the first support 550. The first panel 700 may be mounted to the support grid 5 at the second vertical distance relative to the first support 550 such that the mounting bracket 840 does not contact the first support 550. The second vertical distance may be greater than the first vertical distance.

With the mounting hardware 800, the first panel 700 may be alterable between the first vertical distance and the second vertical distance without having to uncouple the first panel 700 from the first support 550 because the legs 821*a*, 821*b* of the torsion spring 820 may be deformed to allow the first panel 700 to drop beneath the first support 550 without having to remove the torsion spring 820 from the elongated slot 556 of the first support 550.

According to the embodiment shown in FIGS. 13 and 14, for the ceiling system 1 to achieve the desired acoustical properties—both noise reduction and sound attenuation—the second offset distance $D_2$, as measured between the second exposed major surface 702 of the first panel 700 and the first exposed major surface 201 of the second panel 200 may be substantially equal to the second offset distance $D_2$ described with respect to the embodiment of FIGS. 1-8.

With the first panel 700 being located entirely beneath the first support 550 in the embodiment of FIGS. 13 and 14, the first offset distance $D_1$, as measured between the upper surface 61 of the second support 60 and the upper surface 551 of the first support 51 may be relatively smaller in value compared to that of the embodiment shown in FIGS. 1-8. Specifically, the first offset distance $D_1$ of the embodiment of FIGS. 13 and 14 may range from about 0.1 inches to about 4.0 inches—including all distances and sub-ranges there-between.

According to the embodiment shown in FIGS. 13 and 14, a ratio of the first thickness $t_1$ to the first offset distance $D_1$ may range from about 0.025:1 to about 8:1—including all distances and sub-ranges there-between. A ratio of the second thickness $t_2$ to the first offset distance $D_1$ may range from about 0.03125:1 to about 20:1—including all distances and sub-ranges there-between. A ratio of the first offset distance $D_1$ to the second offset distance $D_2$ may range from about 0.5:1 to about 0.95:1—including all distances and sub-ranges there-between.

What is claimed is:

1. A suspended ceiling system comprising:

a ceiling grid comprising:

a first support;

a second support;

the first support is vertically offset from the second support by a first offset distance;

a first panel supported by the first support, the first panel comprising a first exposed major surface opposite a second exposed major surface, the first panel exhibiting an Noise Reduction Coefficient (NRC) value ranging from 0.3 to 0.99;

a second panel supported by the second support, the second panel having a first exposed major surface opposite a second exposed major surface, whereby no line of sight exists between the first and second exposed major surfaces of the second panel;

wherein the second exposed major surface of the first panel faces the first exposed major surface of the second panel, and the second exposed major surface of the first panel is vertically offset from the first exposed major surface of the second panel by a second offset distance;

wherein the first offset distance and the second offset distance are each positive non-zero values; and wherein the second panel has a different airflow resistance than the first panel.

2. The suspended ceiling system according claim 1, wherein the first offset distance is such that the second exposed major surface of the first panel and the first exposed major surface of the second panel are not in contact.

3. The suspended ceiling system according to claim 1, wherein the first panel comprises a first body having a first major surface opposite a second major surface, the first body being porous to allow for airflow between the first and second major surfaces under atmospheric conditions, wherein the first body comprises a first fibrous material selected from fiberglass, mineral wool, synthetic polymers, polyurethane foam, and combinations thereof.

4. The suspended ceiling system according to claim 1, further comprising:

the ceiling grid defining a plurality of grid openings; and wherein one of the first panels and one of the second panels are located within each of the plurality of grid openings, the one of the first and second panels within each of the plurality of grid openings being vertically spaced apart from one another.

5. The suspended ceiling system according to claim 1, wherein the second panel comprises a second body having a first major surface opposite a second major surface, the second body formed of a sound attenuation material.

6. The suspended ceiling system according to claim 1, wherein the first support comprises a first horizontal flange having a first support surface that faces upward, wherein the first panel rests on the first support surface.

7. The suspended ceiling system according to claim 1, wherein the second support comprises a second horizontal flange having a second support surface that faces upward, wherein the second panel rests on the second support surface.

8. The suspended ceiling system according to claim 1, wherein the first offset distance ranges from 0.25 inches to 6.0 inches.

9. The suspended ceiling system according to claim 1, wherein the second panel is supported by the ceiling grid at an elevated position relative to the first panel, and wherein the second panel has a higher airflow resistance than the first panel under atmospheric conditions.

10. The suspended ceiling system according to claim 1, wherein no line of sight exists between the first and second exposed major surfaces of the first panel.

11. The suspended ceiling system according to claim 1, further comprising:

the ceiling grid comprising:

a vertical web extending along a longitudinal axis and having a first side surface located on a first side of the longitudinal axis and a second side surface located on a second side of the longitudinal axis;

the first support extending from the first side surface of the vertical web and having a first width measured from the first side surface of the vertical web to a distal end of the first support; and the second support extending from the first side surface of the vertical web and having a second width measured from the first side surface of the vertical web to a distal end of the second support, the first and second widths being equal.

12. The suspended ceiling system according to claim 1, further comprising:

the ceiling grid comprising:

a vertical web extending along a longitudinal axis and having a first side surface located on a first side of the longitudinal axis and a second side surface located on a second side of the longitudinal axis;

the first support comprising a first portion that extends from the first side surface of the vertical web and a second portion that extends from the second side surface of the vertical web, the first and second portions of the first support having a first equal width; and the second support comprising a first portion that extends from the first side surface of the vertical web and a second portion that extends from the second side surface of the vertical web, the first and second portions of the second support having a second equal width.

13. The suspended ceiling system according to claim 1, wherein the first panel has a first thickness as measured between the first exposed major surface and the second exposed major surface of the first panel, the first thickness ranging from 0.25 inches to 3.0 inches.

14. The suspended ceiling system according to claim 1, wherein the second panel has a second thickness as measured between the first exposed major surface and the second exposed major surface of the second panel, the second thickness ranging from 0.125 inches to 2.0 inches.

15. An acoustical ceiling system comprising:

a support grid having a plurality of grid openings;

a plurality of first panels mounted to the support grid such that one of the plurality of first panels is located within each of the plurality of grid openings, each of the plurality of first panels comprising a first exposed major surface, a second exposed major surface, and a first body formed of a fibrous material and having a first air-permeability;

a plurality of second panels mounted to the support grid such that one of the plurality of second panels is located within each of the plurality of grid openings, each of the plurality of second panels comprising a first exposed major surface, a second exposed major surface, and a second body formed of an attenuation material and having a second air-permeability that is different than the first air-permeability;

wherein the plurality of first panels and the plurality of second panels are supported by the support grid such that the second exposed major surface of each of the plurality of first panels faces the first exposed major surface of a respective one of the plurality of second panels, and wherein a vertical gap exists between the second exposed major surface of each of the plurality of first panels and the first exposed major surface of the respective one of the plurality of second panels such that the plurality of first panels are not in direct contact with any of the plurality of second panels.

16. The acoustical ceiling system according to claim 15, wherein the plurality of first panels exhibit an NRC value ranging from 0.5 to 0.99, wherein the plurality of second panels are sound attenuation panels having a Ceiling Attenuation Class (CAC) performance of at least 35 db, wherein the plurality of second panels are supported in an elevated position relative to the plurality of first panels, and wherein the plurality of second panels have a higher airflow resistance than the plurality of first panels under atmospheric conditions.

17. The acoustical ceiling system according to claim 15, wherein the fibrous material comprises an inorganic fiber, and wherein the sound attenuating material is selected from a fibrous material, synthetic polymer, gypsum board, cement board, and ceramic board.

18. The acoustical ceiling system according to claim 15, wherein the plurality of first panels have a first thickness as measured between the first exposed major surface and the second exposed major surface of the first panel, the first thickness ranging from 0.25 inches to 3.0 inches, and wherein the plurality of second panels have a second thickness as measured between the first exposed major surface and the second exposed major surface of the second panel, the second thickness ranging from 0.125 inches to 2.0 inches.

19. The acoustical ceiling system according to claim 15, wherein the plurality of first panels have a first density and the plurality of second panels have a second density, and wherein a ratio of the second density to the first density is at least 3:1.

* * * * *